US006628050B1

(12) United States Patent
Kameda et al.

(10) Patent No.: US 6,628,050 B1
(45) Date of Patent: Sep. 30, 2003

(54) SPARK PLUG

(75) Inventors: Hiroyuki Kameda, Aichi (JP); Yoshihiro Matsubara, Yokkaichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 194 days.

(21) Appl. No.: 09/705,854

(22) Filed: Nov. 3, 2000

(30) Foreign Application Priority Data

Nov. 16, 1999 (JP) ..... 11-325057

(51) Int. Cl.[7] ..... H01T 13/20
(52) U.S. Cl. ..... 313/143; 313/142; 313/141
(58) Field of Search ..... 313/141, 142, 313/143, 131 R, 140, 118; 445/7

(56) References Cited

U.S. PATENT DOCUMENTS 5,821,676 A * 10/1998 Atchinson et al. ..... 313/140
5,873,338 A 2/1999 Matsubara et al.
6,064,143 A * 5/2000 Kagawa ..... 123/169 EL
6,191,525 B1 * 2/2001 Tanaka et al. ..... 123/169 EL
6,215,233 B1 * 4/2001 Matsubara ..... 313/11.5

FOREIGN PATENT DOCUMENTS

JP 60-232679 11/1985
JP 4262388 9/1992

* cited by examiner

*Primary Examiner*—Robert H. Kim
*Assistant Examiner*—Elizabeth Gemmell
(74) *Attorney, Agent, or Firm*—Brinks Hofer Gilson & Lione

(57) ABSTRACT

A spark plug includes a metallic shell having a stepped portion an insulator disposed inside the metallic shell, while being engaged with the stepped portion of the metallic shell, and having an axially extending through hole; a center electrode fixed within the through hole of the insulator; and a ground electrode having a tip end portion bent toward the center electrode to thereby form a spark discharge gap. The insulator is formed such that the outer diameter of the insulator decreases toward the tip end side from an engagement position at which the insulator engages the stepped portion and such that the diameter decreases stepwise at an axial position between the engagement position and the tip end of the insulator. The diameter reduction ratio Y1=D1/d1 is 0.6 or less in a region of at least 2 mm extending from the tip end surface of the insulator toward the base end side, wherein D1 represents the outer diameter of the insulator measured at an arbitrarily determined axial position, and d1 represents the inner diameter of the tip end portion of the metallic shell. Further, a clearance ratio Y2=(d1−D1)/d1 is 0.4 or greater in a region of at least 1 mm extending from the tip end surface of the metallic shell toward the base end side.

11 Claims, 13 Drawing Sheets

(A) —·—·— CLEARANCE RATIO Y2' BASED ON D13' =38%

(B) —— CLEARANCE RATIO Y2 BASED ON D13 =45%

(A) —·—·— CLEARANCE RATIO Y2' BASED ON D13' =38%

(B) —— CLEARANCE RATIO Y2 BASED ON D13 =45%

(A) —·—·— CLEARANCE RATIO Y2' BASED ON D13' =38%

(B) —— CLEARANCE RATIO Y2 BASED ON D13 =45%

L1
L3
L4
L5
g
D11
d1
D12
D13
3
3e
3e1
3e2
5
5c
5a
5b
3a
3b
4
4a
4b
2
2a
2b
NUMBER OF CYCLES BEFORE REACHING 10MΩ
NUMBER OF CYCLES
0
1
2
3
4
5
6
7
8
9
10
COMPARATIVE EXAMPLE 1
EXAMPLE 8
EXAMPLE 9
EXAMPLE 10

D11
d1
D12
D13
L1
L2
L3
L4
g
3
3e
3e1
3e2
5
5a
5b
3a
3b
2
2a
2b
4
4a
4b
NUMBER OF CYCLES BEFORE REACHING 10MΩ
COMPARATIVE EXAMPLE 2
COMPARATIVE EXAMPLE 3
EXAMPLE 11
0
1
2
3
4
5
6
7
8
9
10
NUMBER OF CYCLES

PRIOR ART

SPARK PLUG

BACKGROUND OF THE INVENTION

1. Field of the Invention

The present invention relates to a spark plug.

2. Description of the Related Art

In a direct injection type gasoline engine (generally called a "direct injection engine") which has been put into practical use in recent years, since gasoline is injected into the engine, an air-fuel mixture readily comes into direct contact with the spark plug. Therefore, substances resulting from incomplete combustion (hereinafter referred to as "uncombusted substances"), such as carbon and uncombusted fuel, accumulate on the spark plug. Such accumulation occurs specifically on the tip end surface of an insulator which fixedly holds a center electrode and on a circumferential surface of the insulator located inside a metallic shell, with the result that smoking occurs in the spark plug. Further, even in a conventional gasoline engine, smoking occurs in a spark plug when the engine is started at a very low temperature; e.g., at −10° C. or lower, in an extremely cold environment.

For example, a conventional surface discharge plug as shown in FIG. 13 which is configured such that spark is produced between a ground electrode 4 and a center electrode 2 and such that at least a portion of the spark travels along the surface of the insulator 3 causing problems at low temperature. At low temperature, an air-fuel mixture condenses into fuel droplets and water droplets (liquid droplets) F, which then enter the space between a metallic shell 5 and the insulator 3. Such liquid droplets flow down along the surface portion (circumferential surface) 3*c* of the insulator 3, and may remain at the tip end portion (lowest portion) of the insulator 3 due to their viscosity. Some carbon particles C adhering to the surface portion 3*c* of the insulator 3 flow down, passing over the liquid droplets F. In such a case, due to inverter voltage remaining in the center electrode 2, the carbon particles C are aligned in a row between the tip end portion 3*a* of the insulator 3 and the tip end portion 4*a* of the ground electrode 4. When volatile components of the liquid droplets F evaporate, only the carbon particles C remain, in the form of a bridge, so that the insulation resistance of the insulator 3 decreases. As a result, sparks are not produced properly at the spark discharge gap g between the center electrode 2 and the ground electrode 4, with the result that engine starting performance at low temperature deteriorates.

Meanwhile, when a spark plug is used for a long period of time in a low-temperature environment such that the electrode temperature of the spark plug becomes 450° C. or lower, a phenomenon called smoking contamination occurs easily. The term "smoking contamination" refers to a phenomenon wherein the surface portion 3*c* of the insulator 3 is covered by electrically conductive contaminants such as carbon C with a resultant decrease in insulation resistance, and therefore spark tends to occur at locations other than the spark discharge gap g; e.g., spark (deep spark) occurs at the side of the base end portion of the metallic shell 5 along the surface portion 3*c* of the insulator 3, with resultant failure in operation. In order to prevent smoking contamination, in some cases, a spark plug is attached to a cylinder head 1 such that the tip end 3*a* of the insulator 3 projects into a combustion chamber 1*b* from a combustion chamber wall 1*a* of the cylinder head 1. In such a case, the insulator 3 is exposed directly to combustion gas, so that the tip end temperature of the spark plug increases, and electrically conductive contaminants such as carbon are combusted with ease by means of a self-cleaning effect. However, the angle of advance ignition at which pre-ignition occurs (hereinafter referred to as "pre-ignition occurrence angle") tends to decrease, with a resultant decrease in heat resistance.

SUMMARY OF THE INVENTION

The present invention generally provides a spark plug comprising a cylindrical metallic shell having a stepped portion on an inner wall thereof; an insulator disposed inside the metallic shell while being engaged with the stepped portion of the metallic shell and having an axially extending through hole; a center electrode fixed within the through hole of the insulator such that a tip end portion of he center electrode projects from the tip end of the insulator or is located at the tip end; and a ground electrode having a base end portion connected to the tip end portion of the metallic shell and a tip end portion bent toward the center electrode to thereby form a spark discharge gap in cooperation with a side surface of the center electrode.

The present invention can be applied not only to spark plugs (such as surface discharge spark plugs and multi-electrode spark plugs) in which spark discharge occurs between the tip end surface of the ground electrode and the side surface of the center electrode, but also to spark plugs (such as parallel-type spark plugs) in which spark discharge occurs between the side surface of the ground electrode and the tip end surface of the center electrode.

According to a first aspect of the present invention, the insulator is formed such that the outer diameter of the insulator decreases toward the tip end side from an engagement position at which the insulator engages the stepped portion and such that the diameter decreases stepwise at an axial position between the engagement position and the tip end of the insulator; and a diameter reduction ratio Y1=D1/d1 is 0.6 or less in a region of at least 2 mm extending from the tip end surface of the insulator toward the base end side, wherein D1 represents the outer diameter of the insulator measured at an arbitrarily determined axial position, and d1 represents the inner diameter of the tip end portion of the metallic shell.

In the spark plug according to the first aspect, since the insulator has a stepped portion, a large space can be secured between the insulator and the metallic shell. Accordingly, fuel and water hardly remain in that space, whereby formation of a bridge of carbon atoms is prevented. Thus, low temperature starting performance does not deteriorate. Further, since the diameter reduction ratio Y1=D1/d1 is 0.6 or less in a region of at least 2 mm extending from the tip end surface of the insulator toward the base end side, a large space can be secured between the insulator and the metallic shell. Therefore, the cooling effect achieved by means of fresh air-fuel mixture is enhanced, so that the temperature increase at the tip end of the spark plug is mitigated even though the tip end portion of the insulator projects into the combustion chamber of the engine. Accordingly, the pre-ignition occurrence angle can be increased, and thus heat resistance can be improved. Moreover, the strength of electric field increases at the stepped portion as compared with other portions. Therefore, even when spark discharge occurs between the circumferential surface of the insulator and the inner wall of the metallic shell, the spark discharge occurs predominantly at the stepped portion, so that spark discharge at the base end side of the metallic shell can be prevented, and a self-cleaning effect provided by spark discharge is enhanced further. Accordingly, high insulation resistance of the insulator can be maintained and smoking contamination hardly occurs.

According to a second aspect of the present invention, the insulator is formed such that the outer diameter of the insulator decreases toward the tip end side from an engagement position at which the insulator engages the stepped portion and such that the diameter decreases stepwise at an axial position between the engagement position and the tip end of the insulator; and a clearance ratio Y2=(d1−D1)/d1 is 0.4 or greater in a region of at least 1 mm extending from the tip end surface of the metallic shell toward the base end side, wherein D1 represents the outer diameter of the insulator measured at an arbitrarily determined axial position, and d1 represents the inner diameter of the tip end portion of the metallic shell.

In the spark plug according to the second aspect, since the insulator has a stepped portion, the tapered portion of the insulator has a stepped portion and the clearance ratio Y2=(d1−D1)/d1 is 0.4 or greater in a region of at least 1 mm extending from the tip end surface of the metallic shell toward the base end side. Therefore, a larger space can be secured between the insulator and the metallic shell. Accordingly, fuel and water hardly remain in that space, whereby formation of a bridge of carbon atoms is prevented. Thus, low temperature starting performance does not deteriorate. Moreover, the strength of electric field increases at the stepped portion as compared with the remaining portion. Therefore, spark discharge at the base end side of the metallic shell can be prevented and a self-cleaning effect provided by spark discharge is enhanced further. Accordingly, high insulation resistance of the insulator can be maintained and smoking contamination hardly occurs.

In the spark plugs of the first and second aspects, when a distance in the radial direction between the tip end surface of the ground electrode and an intersection between a line axially extending from the circumferential surface of the insulator and a line radially extending from the tip end surface of the insulator is defined to be an overlap amount X, the overlap amount X is preferably set to be greater than −0.5 mm but not greater than 0.1 mm. In this case, fuel droplets and water droplets which are produced as a result of condensation of a fuel-air mixture at low temperature and flow down along the surface portion of the insulator encounter difficulty in remaining at the tip end portion (lowest portion) of the insulator, so that formation of a bridge of carbon particles is suppressed. Therefore, starting performance at low temperature is improved.

According to a third aspect of the present invention, when a distance in the radial direction between the tip end surface of the ground electrode and an intersection between a line axially extending from the circumferential surface of the insulator and a line radially extending from the tip end surface of the insulator is defined to be an overlap amount X, the overlap amount X is set to be greater than 0 mm but not greater than 0.1 mm.

In the spark plug of the third aspect, fuel droplets and water droplets which are produced as a result of condensation of an air-fuel mixture at low temperature and flow down along the surface portion of the insulator encounter difficulty in remaining at the tip end portion (lowest portion) of the insulator, so that formation of a bridge of carbon particles is suppressed. Therefore, starting performance at low temperature is improved.

In the spark plug of the third aspect, the insulator being preferably formed such that the outer diameter of the insulator decreases toward the tip end side from an engagement position at which the insulator engages the stepped portion and such that the diameter decreases stepwise at an axial position between the engagement position and the tip end of the insulator. In this case, as in the spark plugs of the first and second aspects, the spark discharge occurs predominantly at the stepped portion, so that spark discharge at the base end side of the metallic shell can be prevented and a self-cleaning effect provided by spark discharge is enhanced further. Accordingly, high insulation resistance of the insulator can be maintained and smoking contamination hardly occurs. Moreover, the pre-ignition occurrence angle can be increased and thus heat resistance can be improved.

Preferably, when the spark plug is attached to the cylinder head of an engine, the tip end portion of the metallic shell projects from a combustion chamber wall toward a combustion chamber and the projection amount L2 is at least 1 mm. In this case, entry of fuel and water into the space between the tip end portion of the metallic shell and the tip end portion of the insulator is suppressed, so that occurrence of bridging at the tip end surface of the metallic shell is prevented.

Preferably, the metallic shell has a substantially constant inner diameter over an area extending between the stepped portion and the tip end portion. In this case, since the inner diameter of the metallic shell can be made relatively small, entry of carbon particles and the like into the space between the tip end portion of the metallic shell and the tip end portion of the insulator is suppressed, whereby smoking contamination is prevented. Further, since the stepped portion formed on the inner wall of the metallic shell has no edge portion, spark discharge at the base end side of the metallic shell can be reduced.

Thus it is an object of the present invention is to provide a spark plug which has excellent low temperature starting performance, heat resistance, and contamination resistance, and which prevents formation of a bridge of carbon particles.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

Figure 1:
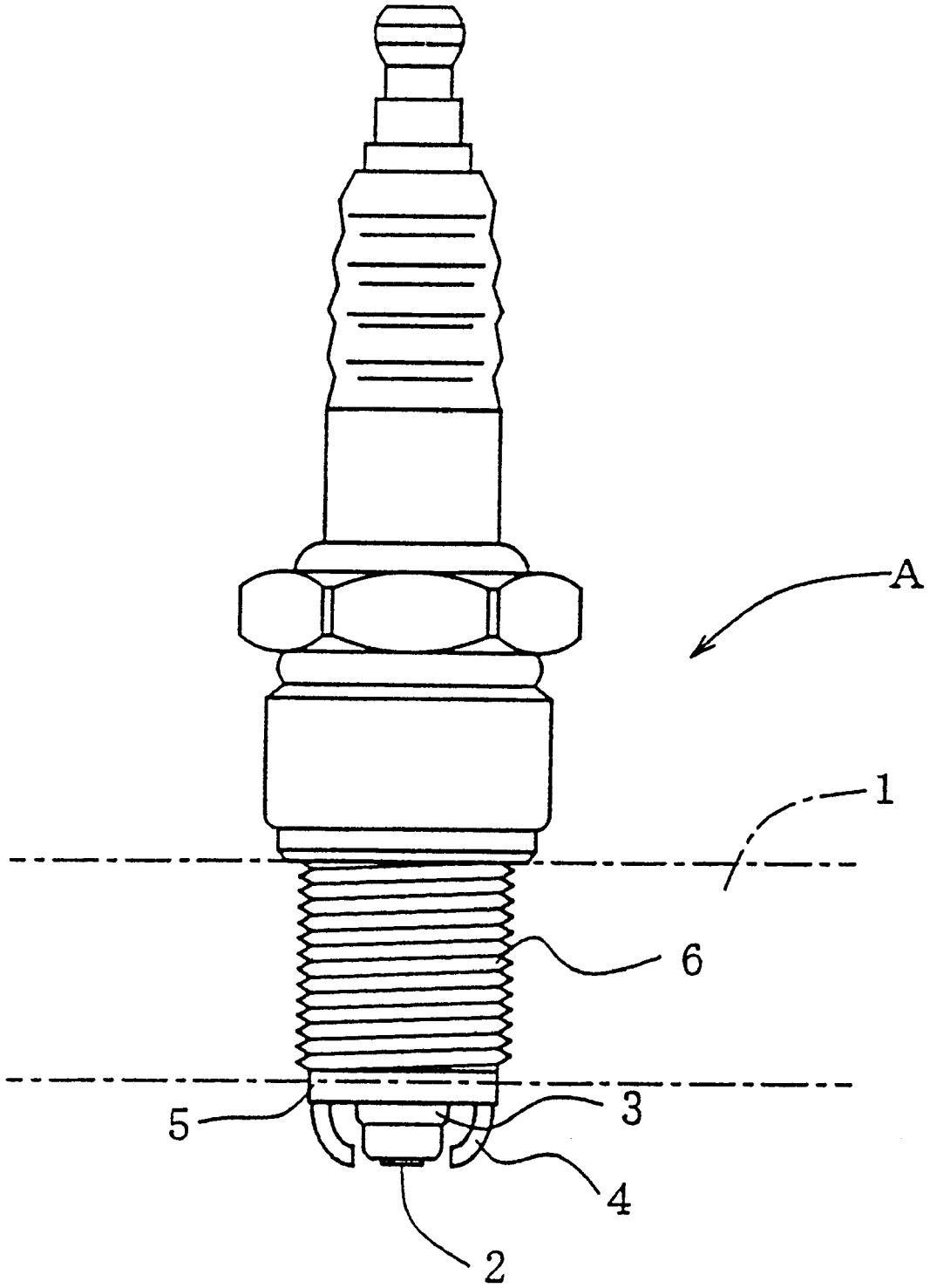
FIG. 1 is a front, elevational view of a spark plug according to a first embodiment of the present invention.

FIG. 1 shows a spark plug A according to a first embodiment of the present invention. The spark plug A is of an intermittent surface discharge type, which is one type of surface discharge spark plug (the configurational feature of the intermittent surface discharge type will be described later). The spark plug A includes a cylindrical metallic shell 5; an insulator 3 fitted into the metallic shell 5 such that the tip end portion of the insulator 3 projects from the metallic shell 5; a center electrode 2 disposed within the insulator 3; and two ground electrodes 4 each having a base end connected to the metallic shell 5. The ground electrodes 4 are disposed such that the tip ends face the side surface (circumferential surface) of the center electrode 2.

Figure 2:
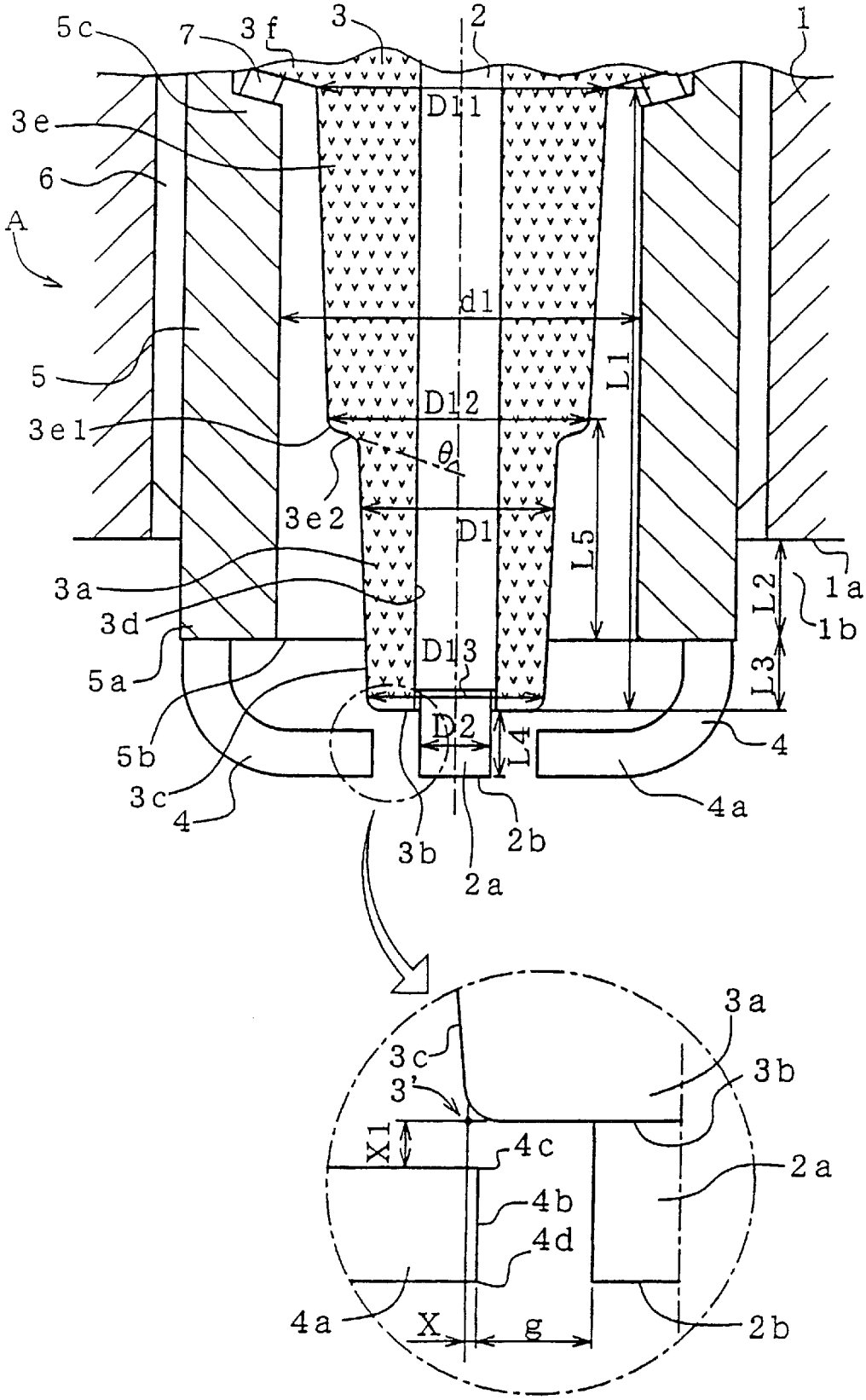
FIG. 2 is an enlarged, fragmentary, longitudinal cross section of the first embodiment spark plug of FIG. 1.

The center electrode 2 and the ground electrodes 4 are each formed of an Ni alloy (Ni-based heat-resistant alloy such as Inconel), and if necessary, a core member (not shown) formed of Cu (or its alloy) of high thermal conductivity is embedded in these electrodes in order to improve heat transmission. The insulator 3 is formed of a sintered ceramic such as alumina or aluminum nitride. As shown in FIG. 2, the insulator 3 has an axially extending through hole 3*d* for receiving the center electrode 2. The metallic shell 5 is formed of a metal such as low-carbon steel and has a tubular shape. The metallic shell 5 serves as a housing of the spark plug A. As shown in FIG. 2, a thread portion 6 used for attaching the spark plug A to a cylinder head 1 is formed on the circumferential surface of the metallic shell 5. When the spark plug A is attached to the cylinder head 1 via the thread portion 6, the tip end portions 2*a*, 4*a*, and 3*a* of the electrodes 2 and 4 and the insulator 3, as well as an extended shell portion 5*a* of the metallic shell 5, project into a combustion chamber 1*b* from a combustion chamber wall 1*a* of the cylinder head 1. As shown in FIG. 2, the two ground electrodes 4 are disposed on opposite sides of the center electrode 2. The tip end portion 4*a* of each ground electrode 4 is bent such that the ends face (hereinafter may be referred to as a "discharge surface") 4*b* faces the circumferential surface of the tip end portion 2*a* of the center electrode 2 in a substantially parallel relation. The base end portion of the ground electrode 4 is fixed to the extended shell portion 5*a* of the metallic shell 5 through welding or other appropriate method. The number of ground electrodes 4 may be three or more, and no limitation is imposed on the number of the ground electrodes 4 insofar as the number of the ground electrodes 4 is not less than two.

In FIG. 2, the tip end surface 3*b* of the insulator 3 is slightly retreated toward the base end portion from the discharge surface 4*b* of the ground electrode 4. More specifically, when the side at which the tip end surface of the center electrode 2 is present is considered to be a front side with respect to the axial direction of the center electrode 2 and the opposite side is considered to be a rear side, the tip end surface 3*b* of the insulator 3 is located on the rear side with respect to the rear side edge 4*c* of the discharge surface 4*b* of the ground electrode 4. The front end surface 2*b* of the center electrode 2 projects by a predetermined amount from the tip end portion 3*b* of the insulator 3. In FIG. 2, the front end surface 2*b* of the center electrode 2 is located at substantially the same axial position as the front edge 4*d* of the discharge surface 4*b* of the ground electrode 4. However, the front end surface 2*b* of the center electrode 2 may be projected or retreated from the front edge (front side edge) 4*d*.

A stepped portion 5*c* for holding a flange portion (engagement portion) 3*f* of the insulator 3 is provided on the inner wall of the metallic shell 5 at the base end side thereof. An annular packing 7 is disposed between the stepped portion 5*c* and the flange portion 3*f*. The inner diameter d1 of the metallic shell 5 is rendered substantially constant in a region extending from the stepped portion 5*c* to the front end portion (extended shell portion) 5*a*, so that the inner diameter d1 of the metallic shell 5 is rendered relatively small in order to prevent entry of carbon particles into the space between the metallic shell 5 and the insulator 3. Thus, smoking contamination is prevented. Further, edged portions (see FIG. 10A) are removed from the stepped portion 5*c* of the metallic shell 5 in order to suppress spark discharge at the stepped portion 5*c*.

In a cross section shown in the lower portion of FIG. 2, which includes the axis, the intersection 3 between a line extending from the circumferential surface 3*c* of the insulator 3 and a line extending from the tip end surface of the insulator 3 is obtained, and the distance between the intersection 3' and the discharge surface 4*b* of the ground electrode 4, which forms the gap g in cooperation with the center electrode 2, is defined as an overlap amount X. In the spark plug A of the present embodiment, the overlap amount X is set such that $-0.5\ \text{mm} < x \leqq 0.1\ \text{mm}$. When the overlap amount X is set less than 0.1 mm, fuel droplets and water droplets which are produced as a result of condensation of an air-fuel mixture at low temperature and flow down along the surface portion (circumferential surface) 3*c* of the insulator 3 encounter difficulty in remaining at the tip end portion (lowest portion) of the insulator 3, so that formation of a bridge of carbon particles is suppressed. Therefore, starting performance at low temperature is improved. In addition, a spark discharged along the surface portion 3*c* of the insulator 3 provides a self-cleaning effect, whereby the insulation resistance of the insulator 3 is maintained high and thus smoking contamination hardly occurs. When the overlap amount X exceeds 0.1 mm, the starting performance at low temperature tends to deteriorate. When the overlap amount X is equal to or less than −0.5 mm; i.e., the discharge surface 4*b* of the ground electrode 4 is located radially outward with respect to the circumferential surface 3*c* of the insulator 3, the clearance between the ground electrode 4 and the insulator 3 increases, so that bridging hardly occurs. However, the clearance (spark discharge gap g) between the center electrode 2 and the ground electrode 4 may become excessively large.

Further, the clearance in the axial direction between the tip end surface 3*b* of the insulator 3 and the rear side edge 4*c* of the discharge surface 4*b* of the ground electrode 4 is defined as a clearance X1. In the spark plug A of the present embodiment, the clearance X1 is set such that 0 mm<x1≦0.7 mm. When the clearance X1 is set to less than 0.7 mm, the above-described low-temperature starting performance and contamination resistance are improved. When the clearance X1 exceeds 0.7 mm, the clearance between the ground electrode 4 and the insulator 3 becomes large, so that bridging hardly occurs. However, the self-cleaning effect may not be provided sufficiently.

A portion (i.e., leg portion 3*e*) of the insulator 3 located on the tip end side with respect to the flange 3*f* is formed such that its outer diameter decreases toward the tip end. In the example shown in FIG. 2, the outer diameter of the leg portion 3*e* decreases toward the tip end through the entire length. When the outer diameter of the insulator 3 measured at an arbitrarily determined axial position is D1, and the inner diameter of the metallic shell 5 is d1, a diameter reduction ratio Y1=D1/d1 becomes 60% or less in a region of about 3.5 mm in length extending from the tip end surface 3*b* of the insulator 3 toward the base end side. Thus, the region in which the diameter reduction ratio Y1 becomes 60% or less extends toward the base end side to a relatively large extent, so that a large space is secured between the insulator 3 and the ground electrode 4 and between the insulator 3 and the metallic shell 5. Thus, the cooling effect by means of fresh air-fuel mixture is enhanced, to thereby improve heat resistance. The lower limit of the diameter reduction ratio Y1 is preferably set to about 40%, in consideration of the outer diameter of the center electrode 2 and the strength of the metallic shell 5. The leg portion 3*e* may be formed such that the diameter does not decrease over the entire length and the leg portion 3*e* has a Constant diameter portion.

Further, the leg portion 3*e* of the insulator 3 is formed such that a clearance ratio Y2=(d1−D1)/d1 becomes 40% or greater in a region of about 2 mm in length extending from the tip end surface 5*b* of the metallic shell 5 (extended shell portion 5*a*) toward the base end side. Thus, the region in which the clearance ratio Y2 becomes 40% or greater extends toward the base end side of the metallic shell 5 to a relatively large extent, so that a large space is secured between the insulator 3 and the metallic shell 5. Thus, fuel or water encounters difficulty in remaining at that space, so that occurrence of bridging is suppressed in order to improve low-temperature starting performance. The upper limit of the clearance ratio Y2 is preferably set to about 60% in consideration of, among other factors, the space in which the center electrode 2 and the insulator 3 are disposed.

Further, in the cross section shown in the lower portion of FIG. 2, an angle between a line tangent to the circumferential surface 3*c* of the insulator 3 and the center axis is defined to be a slant angle θ. The leg portion 3*e* of the insulator 3 includes a first diameter reduction portion 3*e*1 at which the slant angle θ increases and a subsequent second diameter reduction portion 3*e*2 at which the slant angle θ decreases. That is, the outer diameter of the insulator 3 (leg portion 3*e*) decreases abruptly between the first diameter reduction portion 3*e*1 and the second diameter reduction portion 3*e*2, so that a stepped portion is formed between these diameter reduction portions. Accordingly, the strength of electric field increases at the stepped portion, so that spark is discharged more easily than at other portions. As a result, spark discharge at the base end side of the metallic shell 5 decreases, and fuel is reliably ignited at the tip end side of the metallic shell 5. Further, the self-cleaning effect provided by means of spark discharge is enhanced further, so that smoking contamination hardly occurs. In addition, since a large space is secured between the insulator 3 and the metallic shell 5 or the ground electrode 4, the cooling effect by means of fresh air-fuel mixture is enhanced, with the result that the temperature increase at the tip end of the spark plug is mitigated even though the tip end portion 3*a* of the insulator 3 projects into the combustion chamber 1*b* of the engine. As a result, the pre-ignition occurrence angle can be increased, and thus heat resistance is improved.

When the spark plug A is attached to the cylinder head 1 of the engine, the tip end portion (extended shell portion) 5*a* of the metallic shell 5 projects about 1.5 mm into the combustion chamber 1*b* from the fuel chamber wall 1*a*. The design feature of the metallic shell 5 projecting into the combustion chamber 1*b* and the design feature of the leg portion 3*e* of the insulator 3 being formed in the shape of a diameter reduction portion whose outer diameter decreases toward the tip end prevent entry of fuel or water into the space between the tip end portion 5*a* of the metallic shell 5 and the tip end portion 3*a* of the insulator 3, whereby occurrence of bridging is suppressed.

Here, exemplary dimensions of the respective portions in FIG. 2 are given.

Overlap amount X: −0.5 to 0.2 mm

Figure 3A:
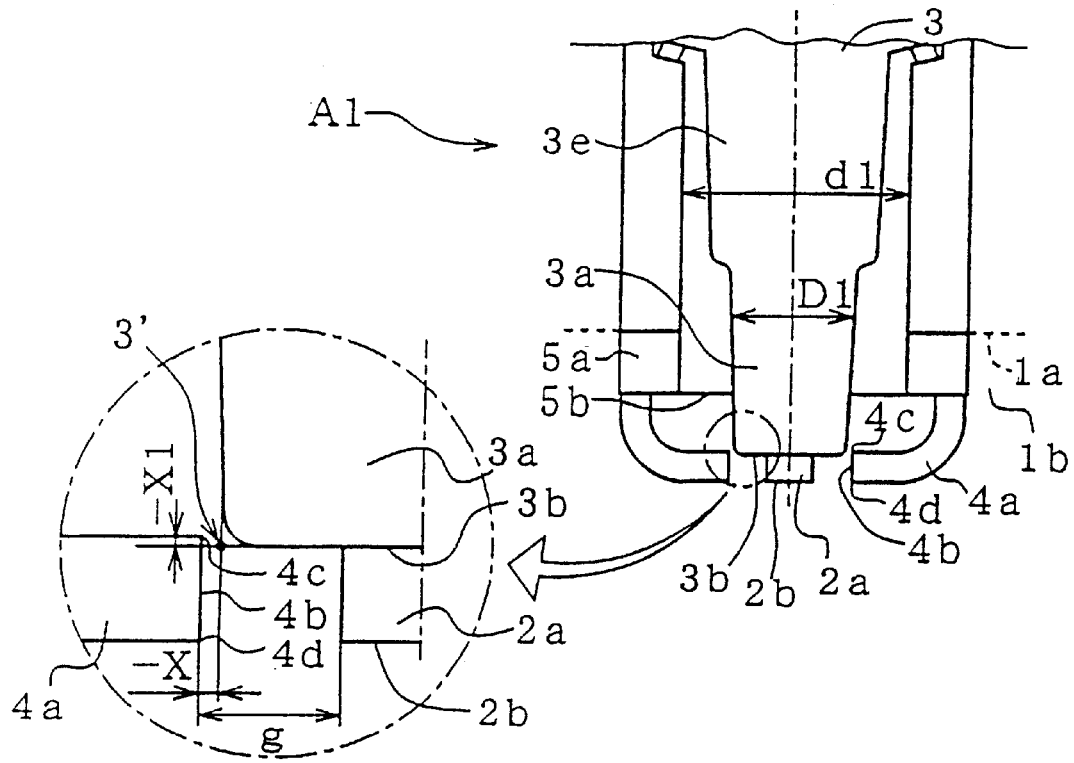
FIGS. 3A and 3B are schematic views showing modifications of the first embodiment spark plug shown in FIG. 2.
Figure 3B:
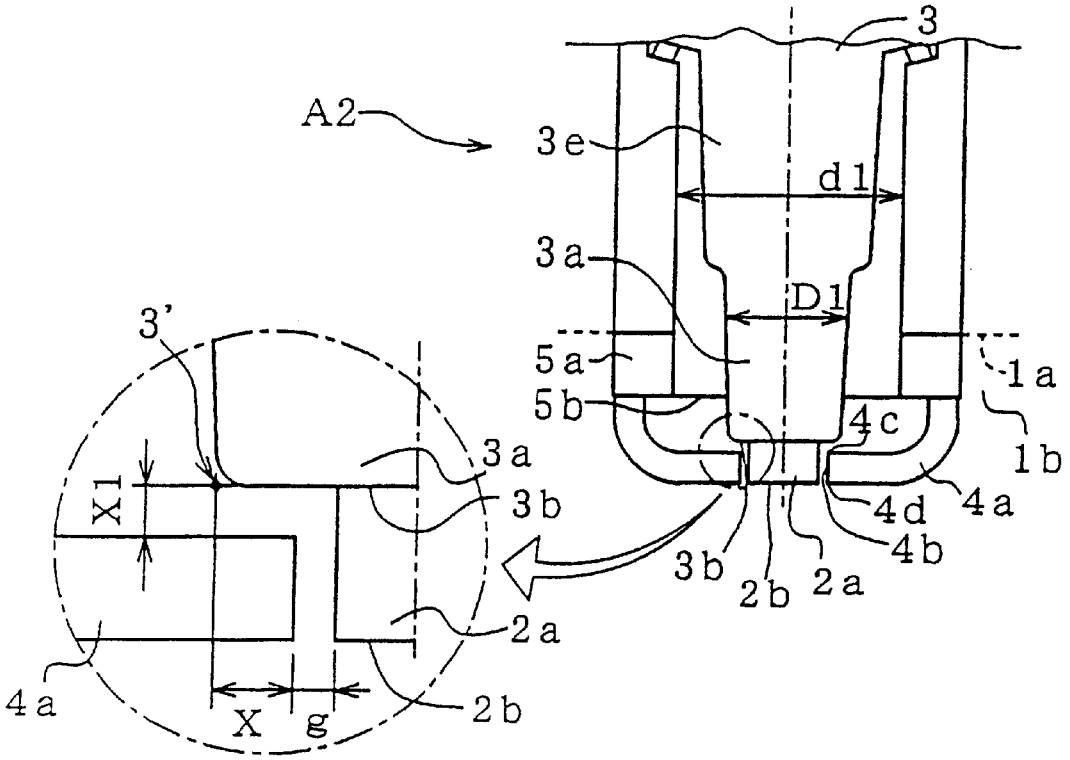

Axial clearance X1 between the insulator 3 and the ground electrode 4: 0 to 0.7 mm Radial clearance (spark discharge gap) g between the center electrode 2 and the ground electrode 4: 0.9 to 1.3 mm Outer diameter D11 of the insulator 3 at the flange 3*f*: 6.2 to 6.9 mm Outer diameter D12 of the insulator 3 at the first diameter reduction portion 3*e*1: 5.2 to 5.6 mm Outer diameter D13 of the insulator 3 at the tip end surface 3*b*: 4.0 to 4.7 mm Diameter D2 of the center electrode 2: 1.8 to 2.5 mm Inner diameter d1 of the metallic shell 5: 7.5 to 8.0 mm Leg length L1 of the insulator 3: 11 to 18 mm Projection amount L2 of the metallic shell 5 into the combustion chamber 1*b*: : 1.5 to 3 mm Axial distance L3 between the tip end surface 5*b* of the metallic shell 5 and the tip end surface 3*b* of the insulator 3: 1.5 to 3.5 mm Axial distance L4 between the tip end surface 3*b* of the insulator 3 and the tip end surface 2*b* of the center electrode 2: 1 to 2.5 mm Axial distance L5 between the tip end surface 5*b* of the metallic shell 5 and the first diameter reduction portion 3*e*1 of the insulator 3: 1 to 2 mm FIGS. 3A and 3B are schematic views showing modifications of the embodiment of FIG. 2, in which the configuration of the present invention described with reference to FIG. 2 is applied to spark plugs of different types. A spark plug A1 shown in FIG. 3A is of a so-called semi-surface discharge type, which is one of surface discharge types. A spark plug A2 shown in FIG. 3B is of a so-called multi-electrode type. Configurational differences among the spark plugs A, A1, and A2 are as follows. Spark plug A1 (FIG. 3A, semi-surface discharge type):

X1<0; i.e., the rear side edge 4*c* of the discharge surface 4*b* of the ground electrode 4 is located rearward (upward in FIG. 3A) relative to the tip end surface 3*b* of the insulator 3. Spark plug A (FIG. 2, intermittent surface discharge type): 0≦X1≦g; i.e., the rear side edge 4*c* of the discharge surface 4*b* of the ground electrode 4 is located forward (downward in FIG. 2) relative to the tip end surface 3*b* of the insulator 3; and the axial distance X1 between the insulator 3 and the ground electrode 4 is not greater than the spark discharge gap g. Spark plug A2 (FIG. 3B, multi-electrode type): X1>g; i.e., the rear side edge 4*c* of the discharge surface 4*b* of the ground electrode 4 is located forward (downward in FIG. 3B) relative to the tip end surface of the insulator 3; and the axial distance X1 between the insulator 3 and the ground electrode 4 is greater than the spark discharge gap g.

In FIGS. 3A and 3B, portions corresponding to those shown in FIG. 2 are denoted by the same reference numerals as those used in FIG. 2; therefore, repetition of their descriptions will be omitted.

Figure 4A:
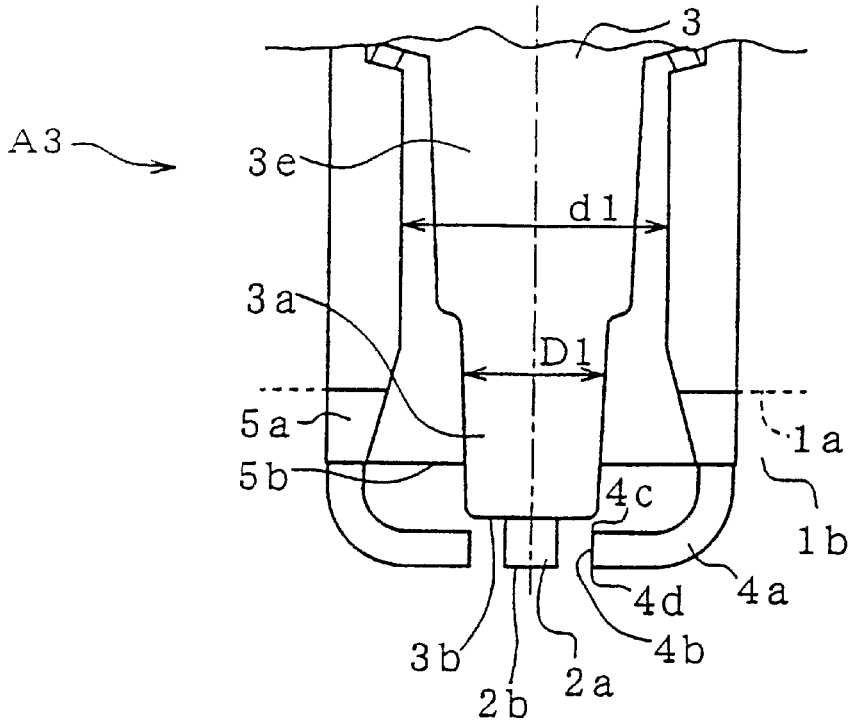
FIGS. 4A and 4B are schematic views showing further modifications of the first embodiment spark plug shown in FIG. 2.
Figure 4B:
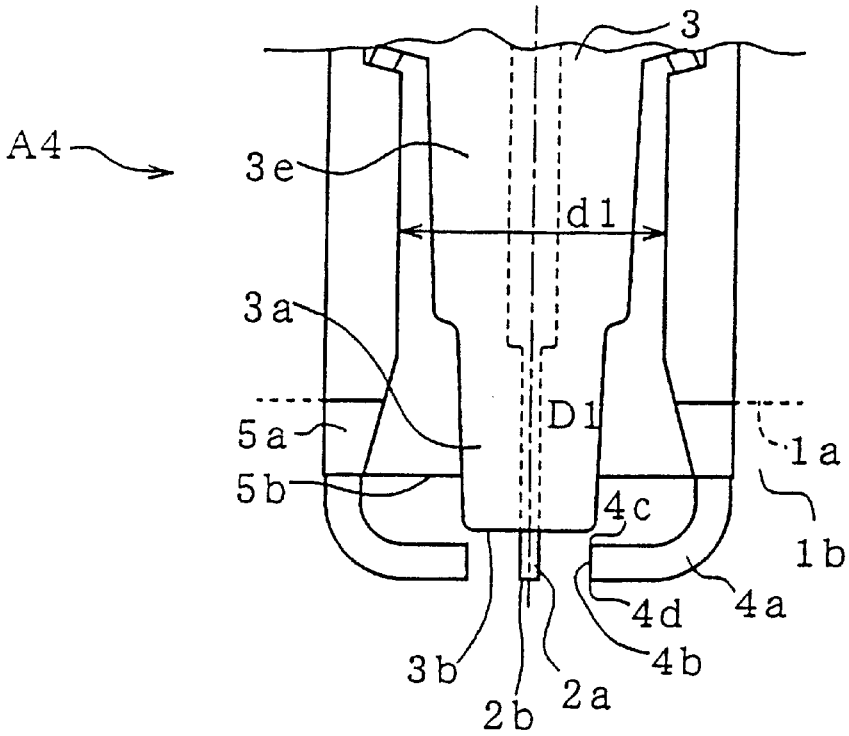

FIGS. 4A and 4B are schematic views showing further modifications of the embodiment of FIG. 2; i.e., other examples of the intermittent surface discharge type spark plug shown in FIG. 2. FIG. 4A shows an exemplary spark plug A3 in which the tip end portion 5*a* of the metallic shell 5 is formed such that the inner diameter d1 increases toward the tip end. Since a larger space is secured between the insulator 3 and the metallic shell 5, the cooling effect by means of fresh air-fuel mixture is enhanced further, so that heat resistance is improved. FIG. 4B shows another exemplary spark plug A4 which has the same structural features as shown in FIG. 4A and an additional structural feature such that the diameter of the center electrode 2 is reduced to 1 mm or less on the tip end side with respect to the first diameter reduction portion 3*e*1 or second diameter reduction portion 3*e*2 of the insulator 3. The area to be cleaned through self-cleaning becomes relatively small, so that improved cleaning performance can be expected. When the diameter of the center electrode 2 is rendered not greater than 1 mm over the entire length, or when a copper core is embedded in the ground electrode 4, the cooling effect is enhanced further in order to improve heat resistance further. In FIGS. 4A and 4B, portions corresponding to those shown in FIG. 2 are denoted by the same reference numerals as those used in FIG. 2; therefore, their repeated descriptions will be omitted.

Figure 5:
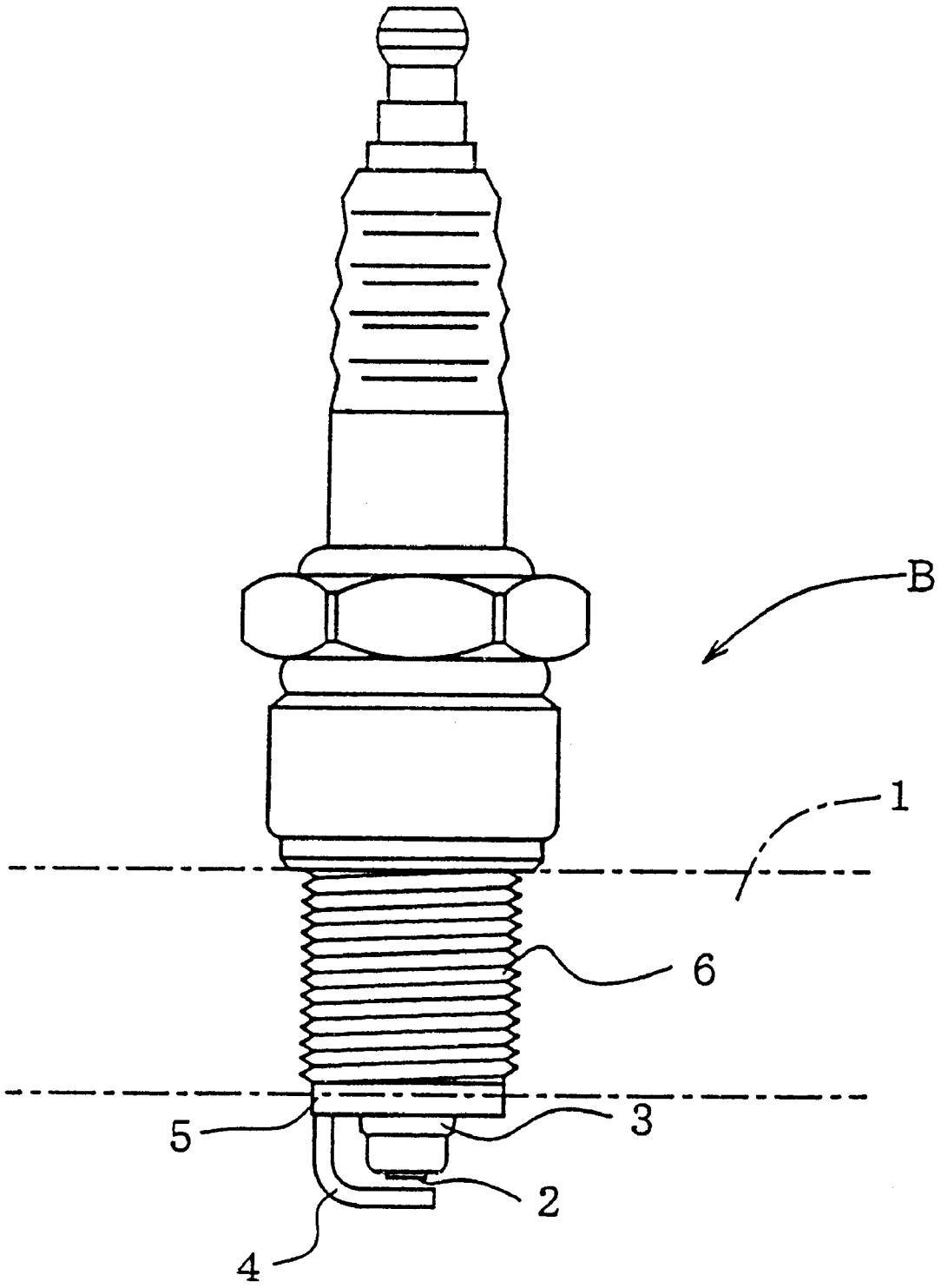
FIG. 5 is a front, elevational view of a spark plug according to a second embodiment of the present invention.
Figure 6:
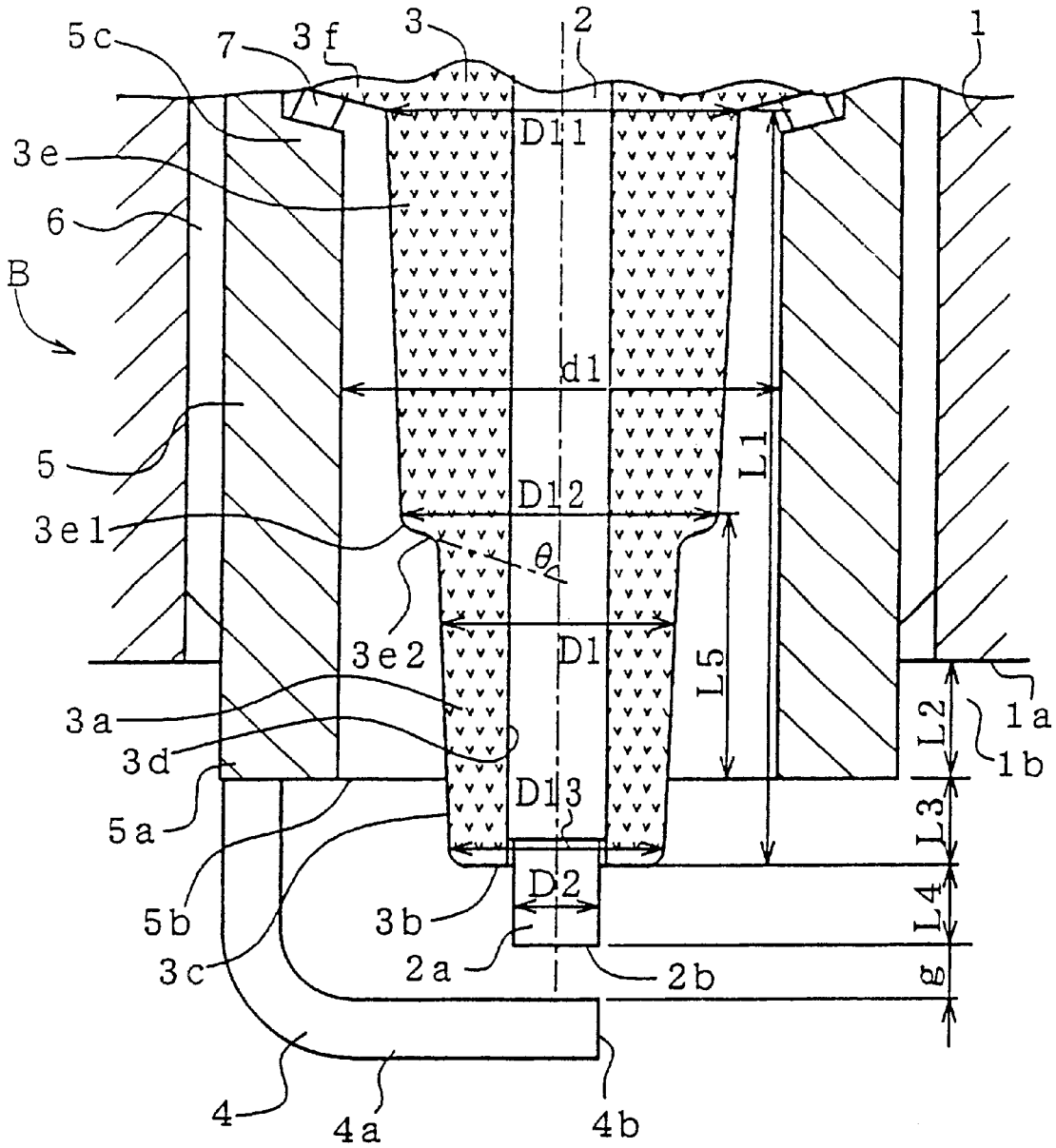
FIG. 6 is an enlarged, fragmentary, longitudinal cross section of the second embodiment spark plug of FIG. 5.

FIG. 5 shows a spark plug B according to a second embodiment of the present invention. The spark plug B is of a so-called parallel type which is designed such that spark discharge occurs between the side surface of the ground electrode and the tip end surface of the center electrode. The spark plug B includes a cylindrical metallic shell 5; an insulator 3 fitted into the metallic shell 5 such that the tip end portion of the insulator 3 projects from the metallic shell 5; a center electrode 2 disposed within the insulator 3; and a ground electrode 4 having a base end connected to the metallic shell 5. The ground electrode 4 is disposed such that one side surface of the ground electrode 4 faces the tip end surface of the center electrode 2. As shown in FIG. 6, the tip end portion 4*a* of the ground electrode 4 is bent such that the side surface faces the tip end surface 2*b* of the center electrode 2 in a substantially parallel relation. The base end portion of the ground electrode 4 is fixed to the extended shell portion 5*a* of the metallic shell 5 through welding or other appropriate method.

A stepped portion 5*c* for holding a flange portion (engagement portion) 3*f* of the insulator 3 is provided on the inner wall of the metallic shell 5 at the base end side. An annular packing 7 is disposed between the stepped portion 5*c* and the flange portion 3*f*. The inner diameter d1 of the metallic shell Sis rendered substantially constant in a region extending from the stepped portion 5*c* to the front-end portion (extended shell portion) 5*a*, as in the spark plug A shown in FIG. 2.

A portion (i.e., leg portion 3*e*) of the insulator 3 located on the tip end side with respect to the flange 3*f* is formed such that its outer diameter decreases toward the tip end. In the example shown in FIG. 5, the outer diameter of the leg portion 3*e* decreases toward the tip end through the entire length. That is, the leg portion 3*e* is formed such that the above-described diameter reduction ratio Y=D1/d1 becomes 60% or less in a region of about 3.5 mm in length extending from the tip end surface 3*b* of the insulator 3 toward the base end side, as in the spark plug A shown in FIG. 2. The lower limit of the diameter reduction ratio Y1 is preferably set to about 40%, in consideration of the outer diameter of the center electrode 2 and the strength of the metallic shell 5. The leg portion 3*e* may be formed such that the diameter does not decrease over the entire length and the leg portion 3*e* has a constant diameter portion.

Further, the leg portion 3*e* of the insulator 3 is formed such that the above-described clearance ratio Y2=(d1−D1)/d1 becomes 40% or greater in a region of about 2 mm in length extending from the tip end surface 5*b* of the metallic shell 5 (extended shell portion 5*a*) toward the base end side. The upper limit of the clearance ratio Y2 is preferably set to about 60% in consideration of, among other factors, the space in which the center electrode 2 and the insulator 3 are disposed.

As in the spark plug A shown in FIG. 2, the leg portion 3*e* of the insulator 3 includes a first diameter reduction portion 3*e*1 at which the slant angle θ increases and a subsequent second diameter reduction portion 3*e*2 at which the slant angle θ decreases.

As in the spark plug A shown in FIG. 2, when the spark plug B is attached to the cylinder head I of an engine, the tip end portion (extended shell portion) 5*a* of the metallic shell 5 projects about 1.5 mm into the combustion chamber 1*b* from the fuel chamber wall 1*a*. In FIG. 6, portions corresponding to those shown in FIG. 2 are denoted by the same reference numerals as those used in FIG. 2; therefore, their repeated description will be omitted.

Here, exemplary dimensions of the respective portions in FIG. 6 are given.

- Outer diameter D11 of the insulator 3 at the flange 3*f*: 6.2 to 6.9 mm
- Outer diameter D12 of the insulator 3 at the first diameter reduction portion 3*e*1: 5.2 to 5.6 mm
- Outer diameter D13 of the insulator 3 at the tip end surface 3*b*: 4.0 to 4.7 mm
- Diameter D2 of the center electrode 2: 1.8 to 2.5 mm
- Inner diameter d1 of the metallic shell 5: 7.5 to 8.0 mm
- Leg length L1 of the insulator 3: 11 to 18 mm
- Projection amount L2 of the metallic shell 5 into the combustion chamber 1*b*: : 1.5 to 3 mm
- Axial distance L3 between the tip end surface 5*b* of the metallic shell 5 and the tip end surface 3*b* of the insulator 3: 1.5 to 3.5 mm
- Axial distance L4 between the tip end surface 3*b* of the insulator 3 and the tip end surface 2*b* of the center electrode 2: 1 to 2 mm
- Radial clearance (spark discharge gap) g between the center electrode 2 and the ground electrode 4: 0.6 to 1.5 mm Axial distance L5 between the tip end surface 5*b* of the metallic shell 5 and the first diameter reduction portion 3*e*1 of the insulator 3: 1 to 2 mm

EXAMPLES

In order to confirm the effects of the present invention, the following performance tests for spark plugs were performed.

Test Example 1

For the intermittent surface discharge spark plug shown in FIG. 7, a test for evaluating low temperature starting performance was performed while the overlap amount X was varied. The test conditions are as follows.

Engine: 4-cycle DOHC engine having a displacement of 1.5 liters

Fuel: Lead-free regular gasoline

Oil: 5W−30

Ambient temperature: −30° C.

Coolant temperature: −30° C.

Oil temperature: −25° C. or lower

Figure 7A:
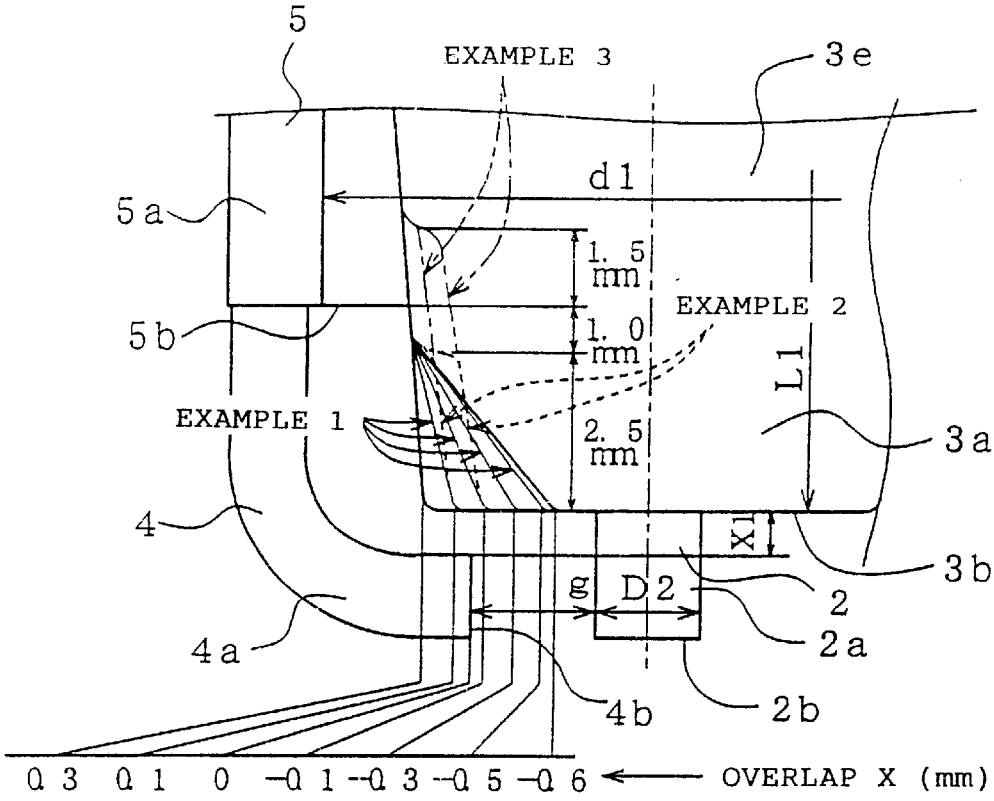
FIG. 7A is a schematic view of a spark plug used in a low temperature starting performance test for determining the relation between low temperature starting performance and overlap amount.

Test pattern: start→ idling (N position, 15 sec)→idling (D position, 15 sec)→ stop Examples 1, 2 and 3:

Spark plugs of Examples 1, 2, and 3 have a configuration shown in FIG. 7A. The respective portions of the spark plugs have the following dimensions.

Axial clearance X1 between the insulator 3 and the ground electrode 4: 0.45 mm

Radial clearance (spark discharge gap) g between the center electrode 2 and the ground electrode 4: 0.9 mm Diameter D2 of the center electrode 2: 2.5 mm Inner diameter d1: of the metallic shell 5: 8.4 mm Leg length L1 of the insulator 3: 14.0 mm As Example 1, four spark plugs were manufactured such that the shape of leg portion 3*e* of the insulator 3 was changed among the shapes illustrated by solid lines in FIG. 7A in order to change the overlap amount X among −0.5 mm, −0.3 mm, −0.1 mm, and +0.1 mm. The above-described test pattern was repeated for each of the thus-manufactured spark plugs, and the number of cycles before starting failure occurred was measured. A spark plug having an overlap amount X of −0.6 mm and a spark plug having an overlap amount X of 0.3 mm serve as Comparative Examples. The test results are shown by a solid line in the graph of FIG. 7B.

Subsequently, as Example 2, two spark plugs were manufactured such that the shape of leg portion 3*e* of the insulator 3 was changed among the shapes illustrated by broken lines in FIG. 7A in order to change the overlap amount X between −0.1 mm and +0.1 mm and such that the diameter reduction ratio Y1=D1/d1 becomes 60% or less at a position 2.5 mm shifted from the tip end surface 3*b* of the insulator 3 toward the base end side. The above-described test pattern was repeated for each of the thus-manufactured spark plugs, and the number of cycles before starting failure occurred was measured. The test results are shown by a broken line in the graph of FIG. 7B.

Further, as Example 3, two spark plugs were manufactured such that the shape of leg portion 3*e* of the insulator 3 was changed among the shapes illustrated by chain lines in FIG. 7A in order to change the overlap amount X between −0.1 mm and +0.1 mm and such that the clearance ratio Y2=(d1−D1)/d1 became 40% or greater at a position 1.5 mm shifted from the tip end surface 5*b* of the metallic shell 5 toward the base end side. The above-described test pattern was repeated for each of the thus-manufactured spark plugs, and the number of cycles before starting failure occurred was measured. The test results are shown by a chain line in the graph of FIG. 7B.

Figure 7B:
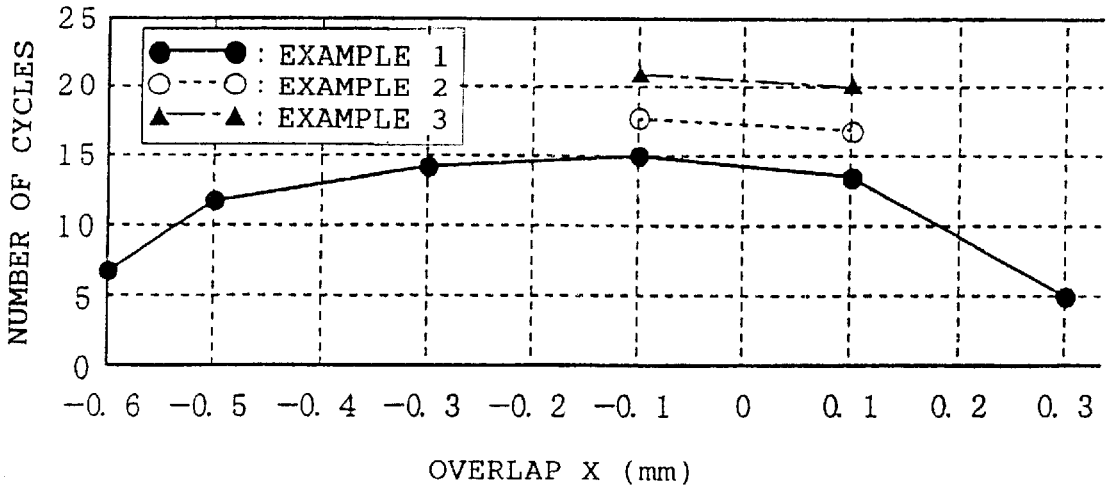
FIG. 7B is a graph showing results of the low temperature starting performance test utilizing the spark plug illustrated in FIG. 7A.

As illustrated by the solid line FIG. 7B, when the overlap amount X exceeds 0.1 mm, the low-temperature starting performance tends to deteriorate (Example 1 and one Comparative Example). Further, as illustrated by the broken line in FIG. 7B, when the leg portion 3*e* of the insulator 3 is formed to have a tapered shape such that the diameter reduction ratio Y1=D1/d1 becomes 60% or less, low-temperature starting performance is improved (Examples 1 and 2). Moreover, as illustrated by the chain line FIG. 7B, when leg portion 3*e* of the insulator 3 is formed to have a tapered shape such that the clearance ratio Y2=(d1−D1)/d1 becomes 40% or greater, low temperature starting performance is improved further (Examples 1, 2, and 3). Accordingly, in the region in which the overlap amount X falls within the range of −0.5 to 0.1 mm, a spark plug having good low-temperature starting performance can be obtained, in cooperation with the tapered shape of the leg portion 3*e* of the insulator 3.

Test Example 2

For the parallel type spark plug shown in FIG. 8, a test for evaluating low temperature starting performance and a test for evaluating heat resistance were performed while the clearance ratio Y2 was varied. The test conditions for the low temperature starting performance test are the same as those employed in Test example 1, and the test conditions for the heat resistance test are as follows.

Engine: 4-cycle DOHC engine having a displacement of 1.6 liters

Fuel: Lead-free regular gasoline

Oil: 5W−30

Ambient temperature/humidity: 20° C./60%

Oil temperature: 80° C.

Test pattern: engine speed: 5500 rpm, WOT (2 min) WOT stands for wide open throttle.

Figure 8A:
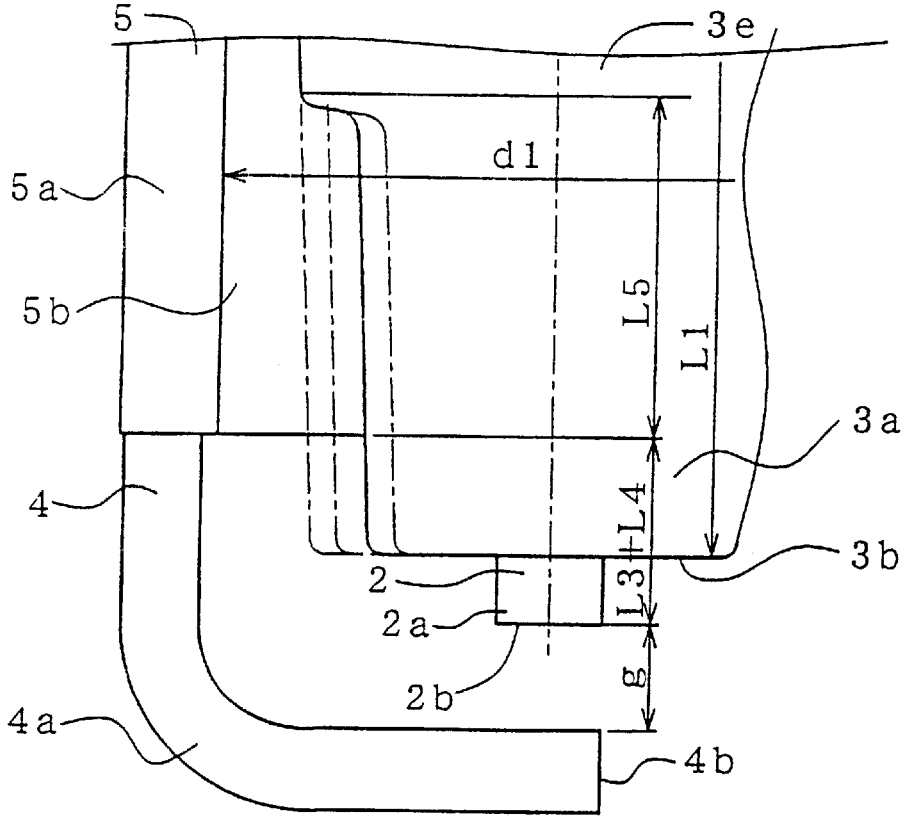
FIG. 8A is a schematic view of a spark plug used in a heat resistance test and a low temperature starting performance test for determining the relation between heat resistance and clearance ratio as well as the relation between low temperature starting performance and clearance ratio.

Example 4:

Spark plugs of Example 4 have a configuration shown in FIG. 8A. The respective portions of the spark plugs have the following dimensions.

Inner diameter d1 of the metallic shell 5: 8.4 mm

Leg length L1 of the insulator 3: 14.0 mm

Total distance (L3+L4) between the tip end surface 5*b* of the metallic shell 5 and the tip end surface 2*b* of the center electrode 2: 2.0 mm Radial clearance (spark discharge gap) g between the center electrode 2 and the ground electrode 4: 1.1 mm Axial distance L5 between the tip end surface 5*b* of the metallic shell 5 and the first diameter reduction portion 3*e*1 of the insulator 3: 3.0 mm As Example 4, two spark plugs were manufactured such that the shape of leg portion 3*e* of the insulator 3 was changed among the shapes illustrated by chain lines in FIG. 8A in order to change the clearance ratio Y2=(di−D1)/d1 between 40% and 50%. The above-described test pattern for the low temperature starting performance test was employed for each of the thus-manufactured spark plugs, and the number of cycles before starting failure occurred was measured. A spark plug having a clearance ratio Y2 of 20% and a spark plug having a clearance ratio Y2 of 30% serve as Comparative Examples. The test results are shown by a solid line in the graph of FIG. 8B.

As Example 4, two spark plugs were manufactured such that the shape of leg portion 3*e* of the insulator 3 was changed among the shapes illustrated by chain lines in FIG. 8A in order to change the clearance ratio Y2=(d1−D1)/d1 between 40% and 50%. The above-described test pattern for the heat resistance test was repeated for each of the thus-manufactured spark plugs, and the pre-ignition occurrence angle was measured. A spark plug having a clearance ratio Y2 of 20% and a spark plug having a clearance ratio Y2 of 30% serve as Comparative Examples. The test results are shown by a broken line in the graph of FIG. 8B.

Figure 8B:
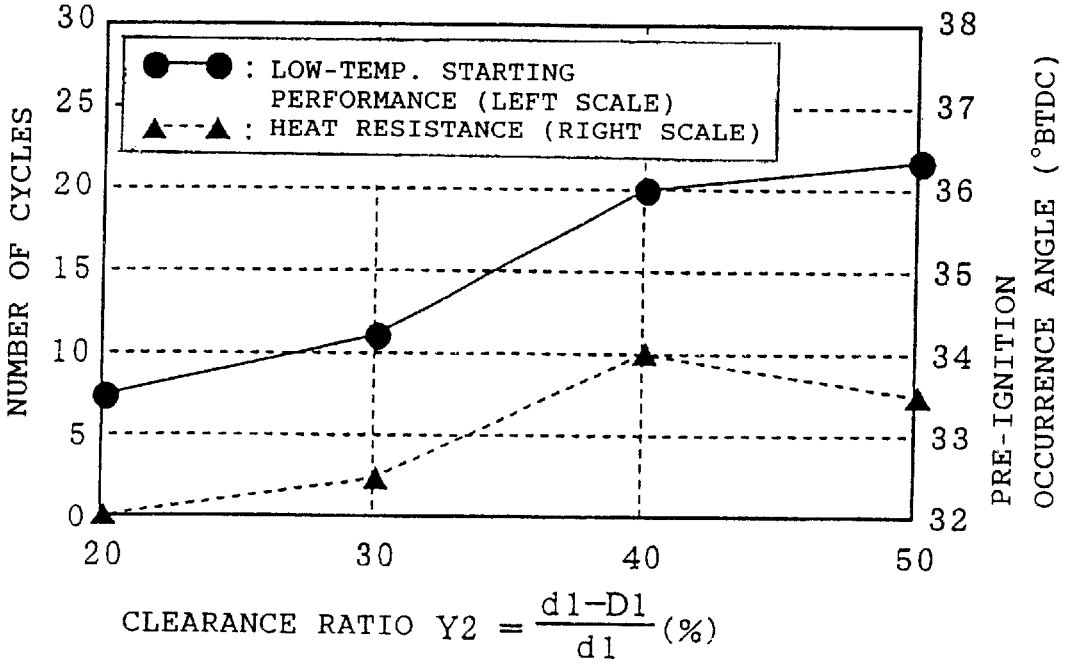
FIG. 8B is a graph showing results of the heat resistance test and the low temperature starting performance test utilizing the spark plug illustrated in FIG. 8A.

As illustrated by the solid line FIG. 8B, when the clearance ratio Y2 becomes less than 40%, the low temperature starting performance tends to deteriorate (Example 4 and Comparative Examples). Further, as illustrated by the broken line FIG. 8B, when the clearance ratio Y2 becomes less than 40%, the heat resistance also tends to deteriorate (Example 4 and Comparative Examples). Here, a larger pre-ignition occurrence angle is associated with higher heat resistance. That is, in a spark plug which hardly causes pre-ignition, even when the ignition timing is advanced further, the period of time during which the spark plug is exposed to fresh air-fuel mixture is relatively short, and the period of time during which the spark plug is exposed to combustion gas becomes relatively long. Therefore, the tip end temperature of the spark plug increases. Such resistance to pre-ignition is called heat resistance. Accordingly, in the region in which the clearance ratio Y2 becomes .40% or higher, a spark plug having good low temperature starting performance and high heat resistance can be obtained.

Test Example 3

Figure 9A:
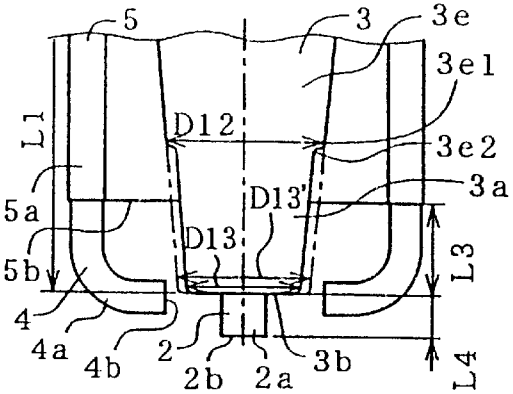
FIGS. 9A, 9B and 9C are schematic views of spark plugs used in another heat resistance test.
Figure 9B:
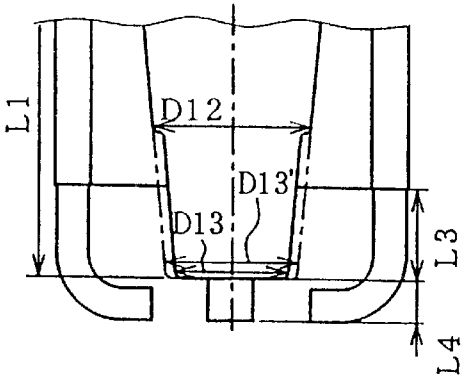
Figure 9C:
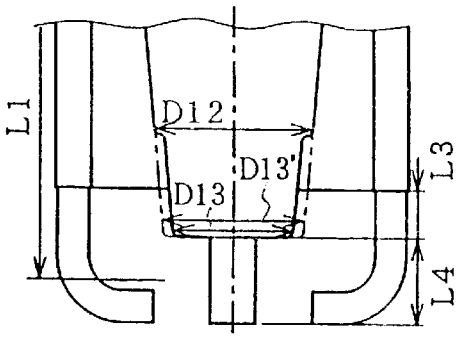

The surface discharge type and multi-electrode type spark plugs shown in FIGS. 9A to 9C were subjected to a heat resistance test while the shape of the leg portion 3*e* of the insulator 3 was changed, in order to elucidate the relationship between heat resistance and presence/absence of the first and second diameter reduction portions 3*e*1 and 3*e*2 on the leg portion 3*e* of the insulator 3. The same test conditions as those employed in Test example 2 were used.

The respective portions of spark plugs of Examples 5, 6, and 7 shown in FIGS. 9A to 9C have the following dimensions. Example 5 (semi-surface discharge type):

Inner diameter d1 of the metallic shell 5: 8.4 mm

Outer diameter D12 of the insulator 3 at the first diameter reduction portion 3*e*1: 5.8 mm Outer diameter D13 of the insulator 3 at the tip end surface 3*b*: 4.6 mm Clearance ratio Y2 calculated on the basis of D13: 45%

Outer diameter D13' of the insulator 3 at the tip end surface 3*b* when the first and second diameter reduction portions 3*e*1 and 3*e*2 are not provided: 5.2 mm Clearance ratio Y2' calculated on the basis of D13': 38%

Leg length L1 of the insulator 3: 14.0 mm

Axial distance L3 between the tip end surface 5*b* of the metallic shell 5 and the tip end surface 3*b* of the insulator 3: 3.5 mm Axial distance L4 between the tip end surface 3*b* of the insulator 3 and the tip end surface 2*b* of the center electrode 2: 2.0 mm Example 6 (intermittent surface discharge type):

Inner diameter d1 of the metallic shell 5: 8.4 mm

Outer diameter D12 of the insulator 3 at the first diameter reduction portion 3*e*1: 5.8 mm Outer diameter D13 of the insulator 3 at the tip end surface 3*b*: 4.6 mm Clearance ratio Y2 calculated on the basis of D13: 45%

Outer diameter D13' of the insulator 3 at the tip end surface 3*b* when the first and second diameter reduction portions 3*e*1 and 3*e*2 are not provided: 5.2 mm Clearance ratio Y2' calculated on the basis of D13': 38%

Leg length L1 of the insulator 3: 14.0 mm

Axial distance L3 between the tip end surface 5*b* of the metallic shell 5 and the tip end surface 3*b* of the insulator 3: 3.5 mm Axial distance L4 between the tip end surface 3*b* of the insulator 3 and the tip end,surface 2*b* of the center electrode 2: 2.0 mm Example 7 (multi-electrode type):

Inner diameter d1 of the metallic shell 5: 8.4 mm

Outer diameter D12 of the insulator 3 at the first-diameter reduction portion 3*e*1: 5.7 mm Outer diameter D13 of the insulator 3 at the tip end surface 3*b*: 4.6 mm Clearance ratio Y2 calculated on the basis of D13: 45%

Outer diameter D13' of the insulator 3 at the tip end surface 3*b* when the first and second diameter reduction portions 3*e*1 and 3*e*2 are not provided: 5.2 mm Clearance ratio Y2' calculated on the basis of D13' : 38%

Leg length L1 of the insulator 3: 13.0 mm

Axial distance L3 between the tip end surface 5*b* of the metallic shell 5 and the tip end surface 3*b* of the insulator 3: 2.5 mm Axial distance L4 between the tip end surface 3*b* of the insulator 3 and the tip end surface 2*b* of the center electrode 2: 2.5 mm Spark plugs of Examples 5, 6, and 7 were fabricated such that the first and second diameter reduction portions 3*e*1 and 3*e*2 were formed on the leg portion 3*e* of the insulator 3 (as illustrated by solid lines in FIGS. 9A to 9C). Similarly, spark plugs of comparative examples corresponding to Examples 5, 6, and 7 were fabricated such that the first and second diameter reduction portions 3*e*1 and 3*e*2 were not formed on the leg portion 3*e* of the insulator 3 (as illustrated by chain lines in FIGS. 9A to 9C). The test results are shown in the graph of FIG. 9D.

Figure 9D:
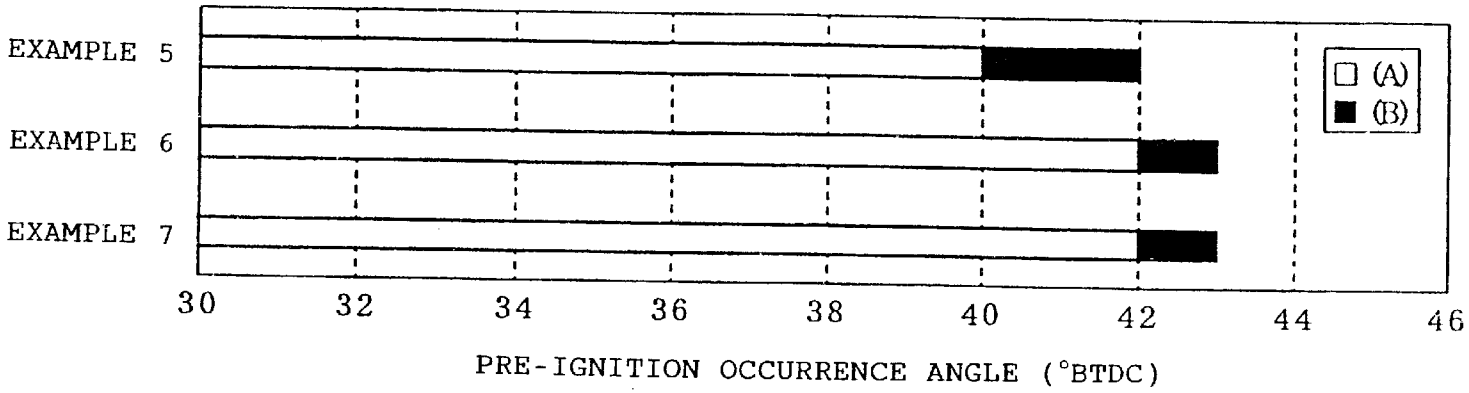
FIG. 9D is a graph showing results of the heat resistance test.

As indicated by black colored bars in FIG. 9D, when the first and second diameter reduction portions 3*e*1 and 3*e*2 are provided, the pre-ignition occurrence angle is large as compared with the case in which the first and second diameter reduction portions 3*e*1 and 3*e*2 are not provided, which indicates high heat resistance. Accordingly, when the leg portion 3*e* of the insulator 3 is tapered such that the first and second diameter reduction portions 3*e*1 and 3*e*2 are provided on the leg portion 3*e*, in general, heat resistance is improved. In Test example 3, only surface discharge and multi-electrode spark plugs were tested. However, parallel type spark plugs (see FIG. 6) are expected to yield similar results.

Text Example 4

Figures 10A, 10B, 10C, 10D:
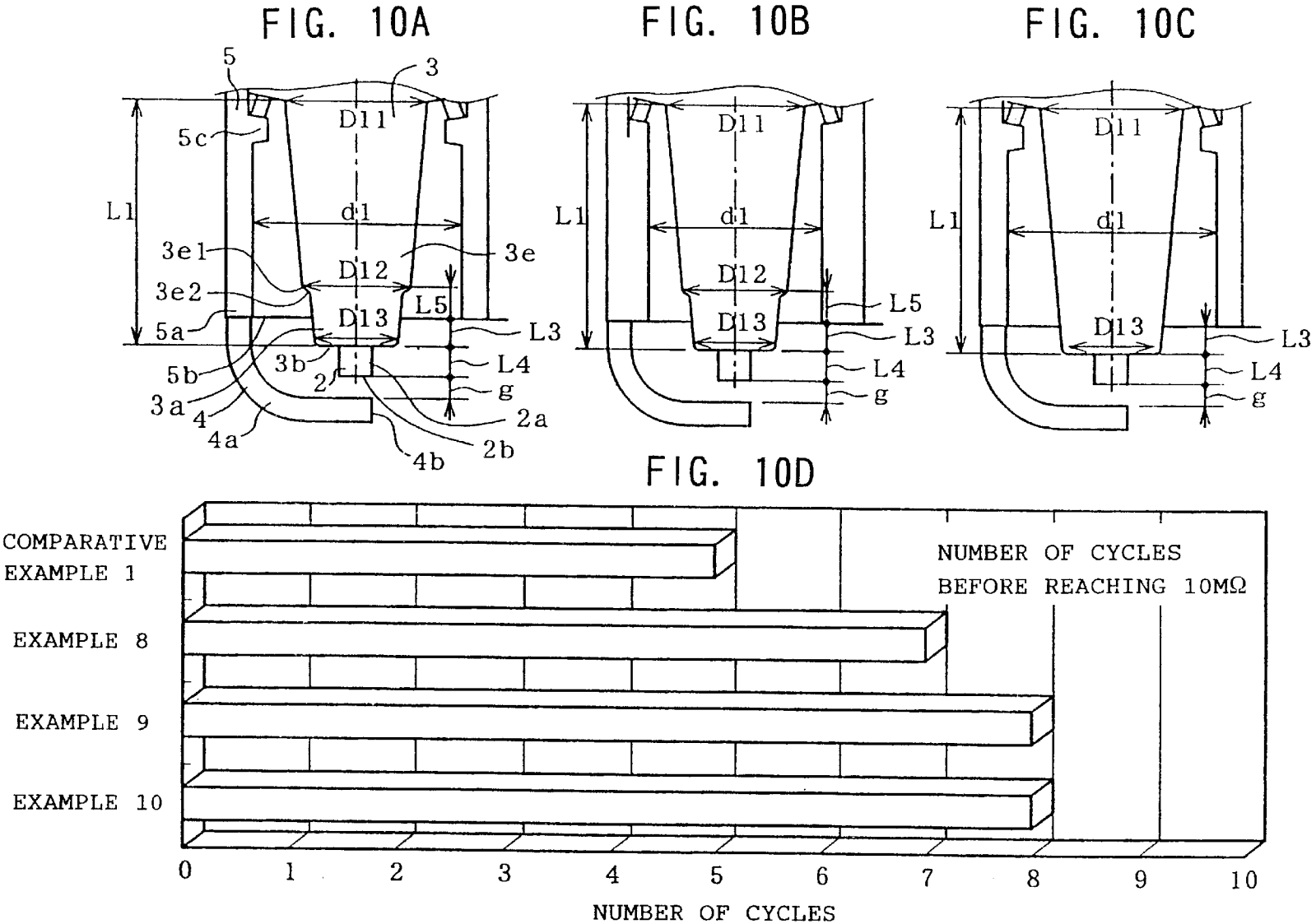
FIGS. 10A, 10B and 10C are schematic views of spark plugs used in a contamination resistance test.
FIG. 10D is a graph showing results of the heat resistance test.

In consideration of the fact that engine malfunction due to smoking contamination occurs before delivery to users, particularly during cold seasons in which fuel encounters difficulty in atomizing, for parallel type spark plugs shown in FIGS. 10A to 10C, a pre-delivery endurance test was carried out in order to elucidate the relationship between contamination resistance and presence/absence of the first and second diameter reduction portions 3*e*1 and 3*e*2 on the leg portion 3*e* of the insulator 3. The test conditions for the pre-delivery endurance test were as follows.

Engine: 4-cycle DOHC engine having a displacement of 2.0 liters

Fuel: Lead-free regular gasoline

Oil: 5W–30

Ambient temperature: −10° C.

Coolant temperature: −10° C.

Test pattern: pattern according to JIS D1606

Figure 11:
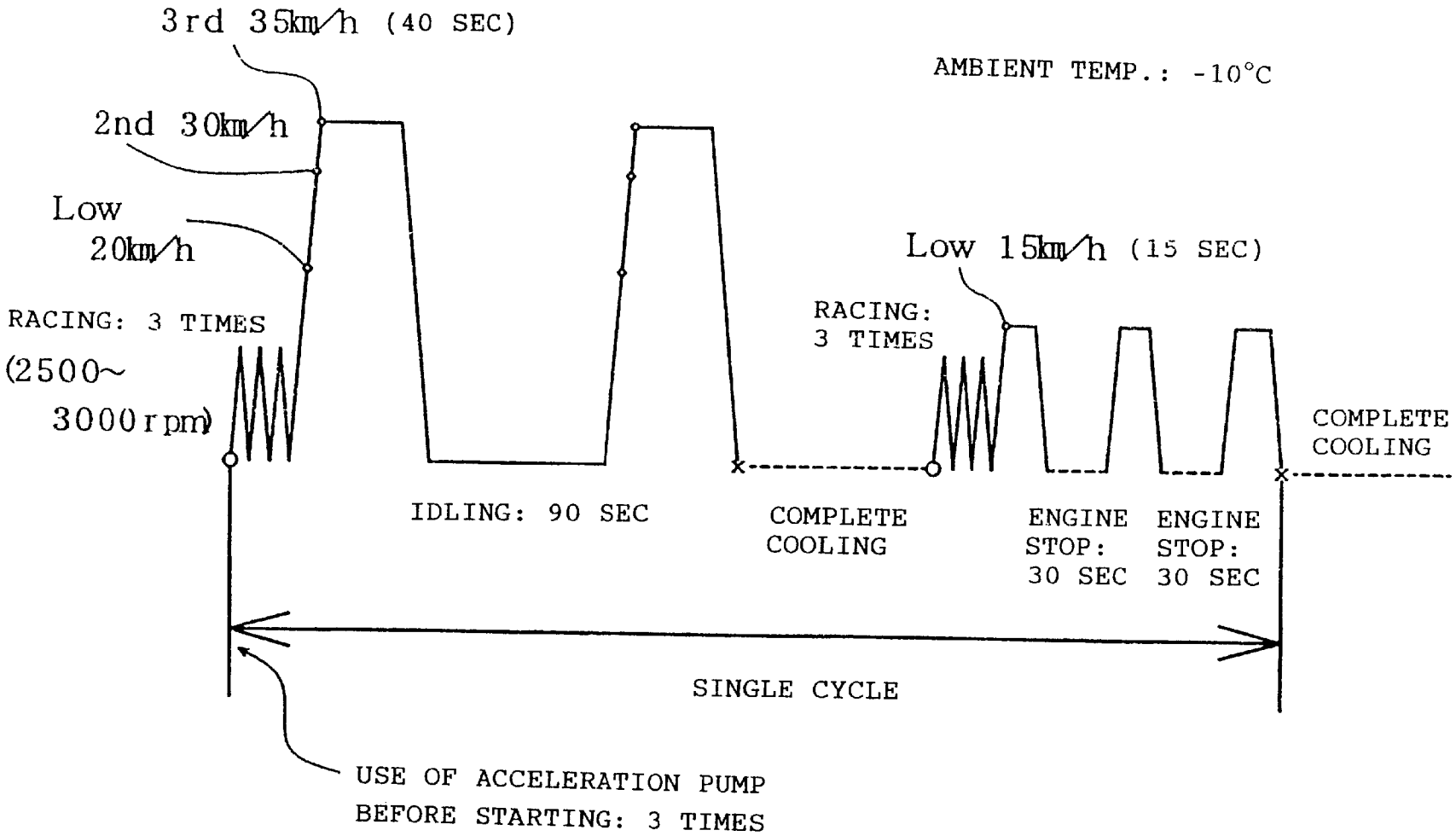
FIG. 11 is a time chart showing a running pattern for the contamination resistance test.

The pattern of JIS D1606 simulates travel for delivery of a vehicle in a cold season. FIG. 11 shows the details of the pattern.

The respective portions of spark plugs of Examples 8, 9, and 10 shown in FIGS. 10A to 10C have the following dimensions.

Example 8

Outer diameter D11 of the insulator 3 at the flange portion 3*f*: 6.5 mm Outer diameter D12 of the insulator 3 at the first diameter reduction portion 3*e*1: 5.6 mm Outer diameter D13 of the insulator 3 at the tip end surface 3*b*: 4.6 mm Inner diameter d1 of the metallic shell 5: 8.4 mm Leg length L1 of the insulator 3: 14.0 mm Axial distance L3 between the tip end surface 5*b* of the metallic shell 5 and the tip end surface 3*b* of the insulator 3: 1.5 mm Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm Axial distance L5 between the tip end surface 5*b* of the metallic shell 5 and the first diameter reduction portion 3*e*1 of the insulator 3: 1.5 mm Example 9

Outer diameter D11 of the insulator 3 at the flange portion 3*f*: 6.5 mm Outer diameter D12 of the insulator 3 at the first diameter reduction portion 3*e*1: 6.0 mm Outer diameter D13 of the insulator 3 at the tip end surface 3*b*: 4.6 mm Inner diameter d1 of the metallic shell 5: 8.4 mm Leg length L1 of the insulator 3: 14.0 mm Axial distance L3 between the tip end surface 5*b* of the metallic shell 5 and the tip end surface 3*b* of the insulator 3: 1.5 mm Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm Axial distance L5 between the tip end surface 5*b* of the metallic shell 5 and the first diameter reduction portion 3*e*1 of the insulator 3: 1.5 mm Example 10

Outer diameter D11 of the insulator 3 at the flange portion 3*f*: 6.5 mm Outer diameter D12 of the insulator 3 at the first diameter reduction portion 3*e*1: 5.6 mm Outer diameter D13 of the insulator 3 at the tip end surface 3*b*: 4.6 mm Inner diameter d1 of the metallic shell 5: 8.0 mm Leg length L1 of the insulator 3: 14.0 mm Axial distance L3 between the tip end surface 5*b* of the metallic shell 5 and the tip end surface 3*b* of the insulator 3: 1.5 mm Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm Axial distance L5 between the tip end surface 5*b* of the metallic shell 5 and the first diameter reduction portion 3*e*1 of the insulator 3: 1.5 mm Notably, in Example 10 the inner diameter d1 of the metallic shell 5 is rendered smaller as compared with Example 8, through elimination of the edge portion of the stepped portion 5*c*.

Comparative Example 1

Outer diameter D11 of the insulator 3 at the flange portion 3*f*: 6.5 mm Outer diameter D13 of the insulator 3 at the tip end surface 3*b*: 5.0 mm Inner diameter d1 of the metallic shell 5: 8.0 mm Leg length L1 of the insulator 3: 14.0 mm Axial distance L3 between the tip end surface 5*b* of the metallic shell 5 and the tip end surface 3*b* of the insulator 3: 1.5 mm Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm.

Notably, in Comparative Example 1, the first and second diameter reduction portions 3*e*1 and 3*e*2 are not formed on the leg portion 3*e* of the insulator 3.

Spark plugs of Examples 8, 9, and 10, as well as a spark plug of Comparative Example 1, were fabricated. The traveling pattern (single cycle) shown in FIG. 11 was repeated for the thus-fabricated spark plugs, and the number of cycles performed before the insulation resistor of each spark plug became 10 MΩ or less due to smoking contamination was measured. The test results are shown in the graph of FIG. 10D.

As shown in the bar graph of FIG 10D, in each of the spark plugs of Examples 8, 9, and 10 in which the first and second diameter reduction portions 3*e*1 and 3*e*2 are provided on the leg portion 3*e* of the insulator 3, the number of cycles performed before the insulation resistor of each spark plug becomes 10 MΩ or less is larger and higher contamination resistance is attained, as compared with the spark plug of Comparative Example 1 in which the first and second diameter reduction portions 3*e*1 and 3*e*2 are not provided. Therefore, when the leg portion 3*e* of the insulator 3 is tapered such that the first and second diameter reduction portions 3*e*1 and 3*e*2 are provided on the leg portion 3*e*, in general, contamination resistance is improved. In the spark plug of Example 10 in which the edge portion of the stepped portion 5*c* of the metallic shell 5 is removed, the number of performed cycles became higher then that in the spark plug of Example 8. This demonstrates that removal of the edge portion is an effective measure for preventing contamination. Further, in Test Example 4, only parallel type spark plugs were tested. However, presumably, similar result would be obtained for surface discharge type and multi-electrode type spark plugs (see FIGS. 2 and 3).

Test Example 5

Figures 12A, 12B, 12C, 12D:
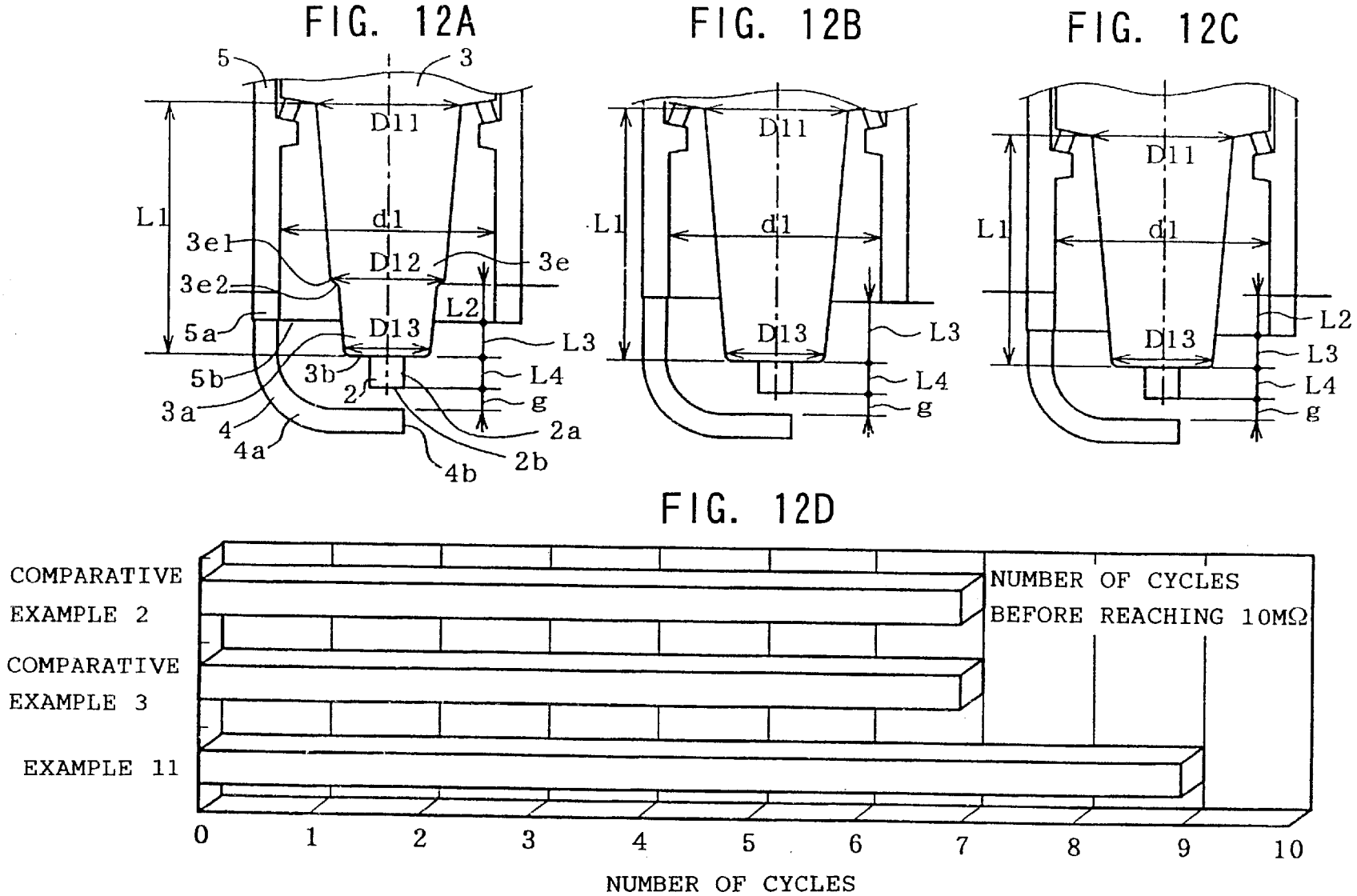
FIGS. 12A, 12B and 12C are schematic views of spark plugs used in another contamination resistance test.
FIG. 12D is a graph showing results of the heat resistance test.
Figure 13:
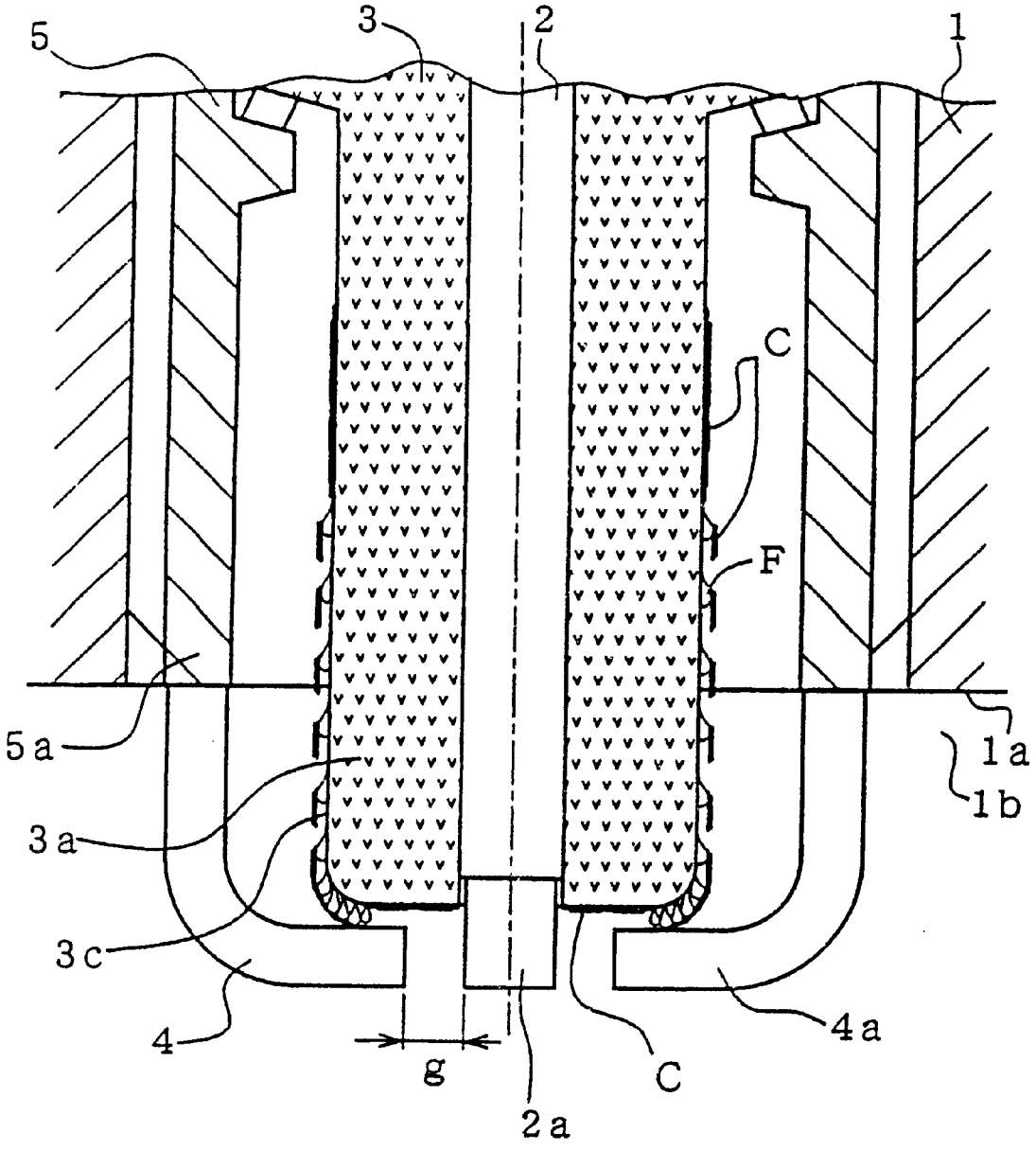
FIG. 13 is a longitudinal cross section of a conventional, prior art, surface discharge spark plug.

For parallel type spark plugs shown in FIGS. 12A to 12C, a pre-delivery endurance test was carried out in order to elucidate the relationship between contamination resistance and presence/absence of the first and second diameter reduction portions 3*e*1 and 3*e*2 on the leg portion 3*e* of the insulator 3, as well as the relationship between contamination resistance and presence/absence of the tip end portion (extended shell portion) 5*a* of the metallic shell 5 within the combustion chamber 1*b*. The test conditions for the pre-delivery endurance test were the same as those employed in Test Example 4.

The respective portions of spark plugs of Examples 11 and Comparative Examples 2 and 3 shown in FIGS. 12A to 12C have the following dimensions.

Example 11

Outer diameter D11 of the insulator 3 at the flange portion 3*f*: 6.5 mm Outer diameter D12 of the insulator 3 at the first diameter reduction portion 3*e*1: 5.6 mm Outer diameter D13 of the insulator 3 at the tip end surface 3*b*: 4.6 mm Inner diameter d1 of the metallic shell 5: 8.4 mm Leg length L1 of the insulator 3: 14.0 mm Projection amount L2 of the metallic shell 5 into the combustion chamber 1*b*: 1.5 mm Axial distance L3 between the tip end surface 5*b* of the metallic shell 5 and the tip end surface 3*b* of the insulator 3: 2.0 mm Axial distance L4 between the tip end surface 3*b* of the insulator 3 and the tip end surface 2*b* of the center electrode 2: 1.5 mm Radial clearance .(spark discharge gap) g between the center electrode 2 and the ground electrode 4: 0.9 mm Comparative Example 2

Outer diameter D11 of the insulator 3 at the flange portion 3*f*: 6.5 mm Outer diameter D13 of the insulator 3 at the tip end surface 3*b*: 5.0 mm inner diameter d1 of the metallic shell 5: 8.4 mm Leg length L1 of the insulator 3: 15.0 mm Axial distance L3 between the tip end surface 5*b* of the metallic shell 5 and the tip end surface 3*b* of the insulator 3: 3.5 mm.

Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm In the spark plug of Comparative Example 2, the first and second diameter reduction portions 3*e*1 and 3*e*2 are not formed on the leg portion 3*e* of the insulator 3, and the tip end portion 5*a* of the metallic shell 5 does not project into the combustion chamber 1*b*.

Comparative Example 3

Outer diameter D11 of the insulator 3 at the flange portion 3*f*: 6.5 mm Outer diameter D13 of the insulator 3 at the tip end surface 3*b*: 5.0 mm Inner diameter d1 of the metallic shell 5: 8.4 mm Leg length L1 of the insulator 3: 13.0 mm Projection amount L2 of the metallic shell 5 into the combustion chamber 1*b*: 1.5 mm Axial distance L3 between the tip end surface 5*b* of the metallic shell 5 and the tip end surface 3*b* of the insulator 3: 2.0 mm Axial distance L4 between the tip end surface 3*b* of the insulator 3 and the tip end surface 2*b* of the center electrode 2: 1.5 mm Radial clearance (spark discharge gap) g between the center electrode 2 and the ground electrode 4: 0.9 mm In the spark plug of Comparative Example 3, the first and second diameter reduction portions 3*e*1 and 3*e*2 are not formed on the leg portion 3*e* of the insulator 3.

Spark plugs of Example 11 and Comparative Examples 2 and 3 were fabricated. The traveling pattern (single cycle) shown in FIG. 11 was repeated for the thus-fabricated spark plugs, and the number of cycles performed before the insulation resistor of each spark plug became 10 MΩ or less due to smoking contamination was measured. The test results are shown in the graph of FIG. 12D.

As shown in the bar graph of FIG. 12D, in the spark plugs of Example 11 fabricated such that the first and second diameter reduction portions 3*e*1 and 3*e*2 are provided on the leg portion 3*e* of the insulator 3 and such that the tip end portion 5*a* of the metallic shell 5 projects into the combustion chamber 1*b*, the number of cycles performed before the insulation resistor becomes 10 MΩ or less is larger, and higher contamination resistance is attained, as compared with the spark plugs of Comparative Examples 2 and 1, which lack at least one of the above-described structural features. Therefore, when the leg portion 3*e* of the insulator 3 is tapered such that the first and second diameter reduction portions 3*e*1 and 3*e*2 are provided on the leg portion 3*e* and the tip end portion 5*a* of the metallic shell 5 projects into the combustion chamber 1*b*, in general, contamination resistance is improved. In Test Example 5, only parallel type spark plugs were tested. However, presumably, similar result would be obtained for surface discharge type and multi-electrode type spark plugs (see FIGS. 2 and 3).

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising, in combination:

a cylindrical metallic shell having a stepped portion on an inner wall thereof;

an insulator disposed inside the metallic shell while being engaged with the stepped portion of the metallic shell, the insulator having an axially extending through hole and being formed such that the outer diameter of the insulator decreases toward the tip end side from an engagement position at which the insulator engages the stepped portion and such that the diameter decreases in a step at an axial position between the engagement position and the tip end of the insulator;

a center electrode fixed within the through hole of the insulator such that a tip end portion of the center electrode projects from the tip end of the insulator or is located at the tip end; and a ground electrode having a base end portion connected to the tip end portion of the metallic shell and a tip end portion bent toward the center electrode to thereby form a spark discharge gap in cooperation with a side surface of the center electrode, wherein a diameter reduction ratio Y1=D1/d1 is 0.6 or less in a region of at least 2 mm extending from the tip end surface of the insulator toward the base end side, wherein D1 represents the outer diameter of the insulator measured at an arbitrarily determined axial position, and d1 represents the inner diameter of the tip end portion of the metallic shell.

2. A spark plug according to claim 1, wherein when a distance in the radial direction between the tip end of the ground electrode and an intersection between a line axially extending from the circumferential surface of the insulator and a line radially extending from the tip end surface of the insulator is defined to be an overlap amount X, the overlap amount X is set to be greater than −0.5 mm but not greater than 0.1 mm.

3. A spark plug according to claim 1, wherein when the spark plug is attached to the cylinder head of an engine, the tip end portion of the metallic shell projects from a combustion chamber wall toward a combustion chamber by an amount of at least 1 mm.

4. A spark plug according to claim 1, wherein the metallic shell has a substantially constant inner diameter over an area extending between the stepped portion and the tip end surface of the metallic shell.

5. A spark plug comprising, in combination:

a cylindrical metallic shell having a stepped portion on an inner wall thereof;

an insulator disposed inside the metallic shell while being engaged with the stepped portion of the metallic shell, the insulator having an axially extending through hole and being formed such that the outer diameter of the insulator decreases toward the tip end side from an engagement position at which the insulator engages the stepped portion and such that the diameter decreases stepwise at an axial position between the engagement position and the tip end of the insulator;

a center electrode fixed within the through hole of the insulator such that a tip end portion of the center electrode projects from the tip end of the insulator or is located at the tip end; and a ground electrode having a base end portion connected to the tip end portion of the metallic shell and a tip end portion bent toward the center electrode to thereby form a spark discharge gap in cooperation with a side surface of the center electrode, wherein a clearance ratio Y2=(d1−D1)/d1 is 0.4 or greater in a region of at least 1 mm extending from the tip end of the metallic shell toward the base end side, wherein D1 represents the outer diameter of the insulator measured at an arbitrarily determined axial position, and d1 represents the inner diameter of the tip end portion of the metallic shell.

6. A spark plug according to claim 5, wherein when a distance in the radial direction between the tip end of the ground electrode and an intersection between a line axially extending from the circumferential surface of the insulator and a line radially extending from the tip end surface of the insulator is defined to be an overlap amount X, the overlap amount X is set to be greater than −0.5 mm but not greater than 0.1 mm.

7. A spark plug according to claim 5, wherein when the spark plug is attached to the cylinder head of an engine, the tip end portion of the metallic shell projects from a combustion chamber wall toward a combustion chamber by an amount of at least 1 mm.

8. A spark plug according to claim 5, wherein the metallic shell has a substantially constant inner diameter over an area extending between the stepped portion and the tip end surface of the metallic shell.

9. A spark plug comprising, in combination:

a cylindrical metallic shell having a stepped portion on an inner wall thereof;

an insulator disposed inside the metallic shell while being engaged with the stepped portion of the metallic shell, the insulator having an axially extending through hole and being formed such that the outer diameter of the insulator decreases toward the tip end side from an engagement position at which the insulator engages the stepped portion and such that the diameter decreases in a step at an axial position between the engagement position and the tip end of the insulator;

a center electrode fixed within the through hole of the insulator such that a tip end portion of the center electrode projects from the tip end of the insulator or is located at the tip end; and a ground electrode having a base end portion connected to the tip end portion of the metallic shell and a tip end portion bent toward the center electrode to thereby form a spark discharge gap in cooperation with a side surface of the center electrode, wherein when a distance in the radial direction between the tip end of the ground electrode and an intersection between a line axially extending from the circumferential surface of the insulator and a line radially extending from the tip end surface of the insulator is defined to be an overlap amount X, the overlap amount X is set to be greater than 0 mm but not greater than 0.1 mm.

10. A spark plug according to claim 9, wherein when the spark plug is attached to the cylinder head of an engine, the tip end portion of the metallic shell projects from a combustion chamber wall toward a combustion chamber by an amount of at least 1 mm.

11. A spark plug according to claim 9, wherein the metallic shell has a substantially constant inner diameter over an area extending between the stepped portion and the tip end surface of the metallic shell.

* * * * *

UNITED STATES PATENT AND TRADEMARK OFFICE

CERTIFICATE OF CORRECTION

PATENT NO. : 6,628,050 B1
DATED : September 30, 2003
INVENTOR(S) : Hiroyuki Kameda et al.

It is certified that error appears in the above-identified patent and that said Letters Patent is hereby corrected as shown below:

Title page,
Item [56], References Cited, U.S. PATENT DOCUMENTS, insert:
-- 5,189,333 2/1993 Kagawa et al. --.

Signed and Sealed this

Twenty-third Day of March, 2004

JON W. DUDAS
*Acting Director of the United States Patent and Trademark Office*